US008468753B2

(12) United States Patent
Donnally et al.

(10) Patent No.: US 8,468,753 B2
(45) Date of Patent: Jun. 25, 2013

(54) DRILLING RIGS AND ERECTION METHODS

(75) Inventors: Robert Benjamin Donnally, Shanghai (CN); Chunqiao Ren, Shanghai (CN); Stuart Arthur Lyall McCurdy, Edmonton (CA); Xi Lin Liu, Puyang (CN); Hui Chun Sheng, Shanghai (CN); Yan Yu, Shanghai (CN)

(73) Assignee: National Oilwell Varco L.P., Houston, TX (US)

( * ) Notice: Subject to any disclaimer, the term of this patent is extended or adjusted under 35 U.S.C. 154(b) by 1058 days.

(21) Appl. No.: 12/074,270

(22) Filed: Feb. 29, 2008

(65) Prior Publication Data

US 2009/0218139 A1 Sep. 3, 2009

(51) Int. Cl.
*E04H 12/18* (2006.01)
*E04H 12/34* (2006.01)

(52) U.S. Cl.
USPC ..... 52/117; 52/123.1; 52/118; 52/111; 52/745.17; 52/745.18; 173/186; 173/189

(58) Field of Classification Search
USPC ..... 52/123.1, 111, 117–118, 745.17–745.18, 52/120, 40; 173/1, 186, 189, 28, 184, 161, 173/85, 24
See application file for complete search history.

(56) References Cited

U.S. PATENT DOCUMENTS

| | | | | |
|---|---|---|---|---|
| 2,268,796 | A | 1/1942 | Brauer | 189/15 |
| 2,617,500 | A * | 11/1952 | Cardwell et al. | 52/115 |
| 2,701,039 | A | 2/1955 | Woolslayer et al. | 52/292 |
| 2,703,634 | A | 3/1955 | Lee | 52/115 |
| 2,804,948 | A | 9/1957 | Woolslayer | 52/118 |
| 2,857,993 | A * | 10/1958 | Terrell | 52/120 |
| 2,975,910 | A | 3/1961 | Conrad | 212/300 |
| 2,993,570 | A | 7/1961 | Bender | 52/118 |
| 3,033,527 | A * | 5/1962 | Wilson | 254/323 |
| 3,109,523 | A | 11/1963 | Moller | 52/115 |
| 3,201,091 | A | 8/1965 | Woolslayer et al. | 51/120 X |
| 3,228,151 | A | 1/1966 | Woolslayer et al. | 52/64 |
| 3,262,237 | A | 7/1966 | Jenkins et al. | 52/116 |
| 3,333,377 | A | 8/1967 | Woolslayer et al. | 52/116 |
| 3,340,938 | A | 9/1967 | Wilson | 173/28 |
| 3,483,933 | A * | 12/1969 | Dyer et al. | 173/39 |
| 3,749,183 | A | 7/1973 | Branham et al. | 173/151 |
| 3,807,109 | A * | 4/1974 | Jenkins et al. | 52/120 |

(Continued)

FOREIGN PATENT DOCUMENTS

| | | |
|---|---|---|
| GB | 195862 | 3/1922 |
| GB | 1 478 648 | 9/1974 |

(Continued)

OTHER PUBLICATIONS

PCT/GB2009/050202 Partial International Search Report (Aug. 17, 2010).

(Continued)

*Primary Examiner* — Phi A
(74) *Attorney, Agent, or Firm* — Williams, Morgan & Amerson, P.C.

(57) ABSTRACT

Systems and methods for erecting a drilling rig. This abstract is provided to comply with the rules requiring an abstract which will allow a searcher or other reader to quickly ascertain the subject matter of the technical disclosure and is submitted with the understanding that it will not be used to interpret or limit the scope or meaning of the claims, 37 C.F.R. 1.72(b).

31 Claims, 21 Drawing Sheets

U.S. PATENT DOCUMENTS

| | | | | | |
|---|---|---|---|---|---|
| 3,922,825 | A | * | 12/1975 | Eddy et al. | 52/116 |
| 3,942,593 | A | | 3/1976 | Reeve, Jr. et al. | 173/23 |
| 3,981,485 | A | | 9/1976 | Eddy et al. | 254/186 R |
| 3,987,594 | A | | 10/1976 | Rao et al. | 52/111 |
| 4,005,779 | A | | 2/1977 | Andrews | 212/87 |
| 4,021,978 | A | * | 5/1977 | Busse et al. | 52/118 |
| 4,024,924 | A | | 5/1977 | Hauck | 173/151 |
| 4,103,503 | A | | 8/1978 | Smith | 61/97 |
| 4,105,347 | A | | 8/1978 | Gossage | 403/157 |
| 4,135,340 | A | * | 1/1979 | Cox et al. | 52/115 |
| 4,138,805 | A | | 2/1979 | Patterson | 52/118 |
| 4,221,088 | A | | 9/1980 | Patterson | 52/116 |
| 4,267,675 | A | * | 5/1981 | Cochran | 52/118 |
| 4,269,009 | A | | 5/1981 | Lawrence | 52/116 |
| 4,269,395 | A | | 5/1981 | Neuman et al. | 254/386 |
| 4,290,495 | A | | 9/1981 | Elliston | 175/85 |
| 4,292,772 | A | | 10/1981 | Borg et al. | 52/118 |
| 4,305,237 | A | | 12/1981 | Borg et al. | 52/116 |
| 4,366,650 | A | | 1/1983 | Patterson | 52/118 |
| 4,368,602 | A | | 1/1983 | Manten | 52/115 |
| 4,371,041 | A | | 2/1983 | Becker et al. | 173/28 |
| 4,371,046 | A | * | 2/1983 | Read | 175/57 |
| 4,375,892 | A | | 3/1983 | Jenkins et al. | 280/43.23 |
| 4,438,904 | A | | 3/1984 | White | 254/311 |
| 4,478,015 | A | | 10/1984 | Lawrence et al. | 52/120 |
| 4,489,526 | A | * | 12/1984 | Cummins | 52/125.6 |
| 4,569,168 | A | * | 2/1986 | McGovney et al. | 52/122.1 |
| 4,587,778 | A | | 5/1986 | Woolslayer et al. | 52/116 |
| 4,591,006 | A | | 5/1986 | Hutchison | 175/52 |
| 4,630,425 | A | | 12/1986 | Reed | 52/45.18 |
| 4,684,314 | A | | 8/1987 | Luth | 414/745 |
| 4,757,592 | A | * | 7/1988 | Reed | 29/429 |
| 4,821,816 | A | * | 4/1989 | Willis | 175/57 |
| 4,831,795 | A | * | 5/1989 | Sorokan | 52/120 |
| 4,837,992 | A | | 6/1989 | Hashimoto | 52/118 |
| 4,899,832 | A | * | 2/1990 | Bierscheid, Jr. | 173/187 |
| 4,932,175 | A | * | 6/1990 | Donnally | 52/118 |
| 5,107,940 | A | * | 4/1992 | Berry | 175/85 |
| 5,109,934 | A | | 5/1992 | Mochizuki | 175/170 |
| 5,251,709 | A | | 10/1993 | Richardson | 175/1 |
| 5,342,020 | A | | 8/1994 | Stone | 254/269 |
| 5,425,435 | A | | 6/1995 | Gregory | 188/77 W |
| 5,709,277 | A | | 1/1998 | Geldner | 175/203 |
| 5,921,329 | A | | 7/1999 | Armstrong | 175/57 |
| 6,029,951 | A | | 2/2000 | Guggari | 254/269 |
| 6,182,945 | B1 | | 2/2001 | Dyer et al. | 254/340 |
| 6,474,926 | B2 | | 11/2002 | Weiss | 414/332 |
| 6,523,319 | B2 | * | 2/2003 | Bockhorn et al. | 52/651.01 |
| 6,634,436 | B1 | * | 10/2003 | Desai | 173/1 |
| 6,848,515 | B2 | * | 2/2005 | Orr et al. | 173/1 |
| 6,860,337 | B1 | * | 3/2005 | Orr et al. | 173/28 |
| 6,944,547 | B2 | | 9/2005 | Womer et al. | 702/7 |
| 6,962,030 | B2 | | 11/2005 | Conn | 52/741.1 |
| 6,994,171 | B2 | * | 2/2006 | Orr et al. | 173/28 |
| 7,155,873 | B2 | | 1/2007 | Palidis | 52/702 |
| 7,210,670 | B2 | | 5/2007 | Franks | 254/294 |
| 7,246,471 | B2 | | 7/2007 | Riermann et al. | 52/283 |
| 7,306,055 | B2 | * | 12/2007 | Barnes | 175/57 |
| 7,308,953 | B2 | * | 12/2007 | Barnes | 175/203 |
| 7,357,616 | B2 | * | 4/2008 | Andrews et al. | 414/332 |
| 7,377,335 | B2 | | 5/2008 | Jones et al. | 175/57 |
| 7,413,393 | B1 | * | 8/2008 | Barnes | 414/373 |
| 2004/0211572 | A1 | | 10/2004 | Orr et al. | 173/1 |
| 2004/0211598 | A1 | | 10/2004 | Palidis | 175/162 |
| 2004/0212598 | A1 | | 10/2004 | Kraus et al. | 345/168 |
| 2004/0240973 | A1 | * | 12/2004 | Andrews et al. | 414/332 |
| 2005/0193645 | A1 | | 9/2005 | Barnes | 52/120 |
| 2005/0194189 | A1 | * | 9/2005 | Barnes | 175/122 |
| 2005/0236790 | A1 | | 10/2005 | Carter | 280/79.11 |
| 2006/0213653 | A1 | | 9/2006 | Cunningham et al. | 166/77.1 |
| 2009/0218138 | A1 | | 9/2009 | Donnally et al. | 175/57 |
| 2009/0218144 | A1 | | 9/2009 | Donnally et al. | 175/162 |

FOREIGN PATENT DOCUMENTS

| | | | |
|---|---|---|---|
| GB | 2 046 332 | | 11/1980 |
| JP | 57197322 | A * | 12/1982 |
| JP | 57197324 | A * | 12/1982 |
| JP | 59076326 | A * | 5/1984 |

OTHER PUBLICATIONS

Mobile Rigs, National Oilwell. 8 pp.. 2005.
Ideal Rig System, National Oilwell. 8 pp. 2004.
U.S. Appl. No. 12/069,913, filed Feb. 13, 2008, Chehade et al.
U.S. Appl. No. 12/074,258, filed Feb. 29, 2008, Donnally et al.
U.S. Appl. No. 12/074,264, filed Feb. 29, 2008, Donnelly et al.
U.S. Appl. No. 12/074,232, filed Feb. 29, 2008, Donnally et al.
Partial International Search Report and Written Opinion PCT/GB2009/050202 dated Jan. 27, 2011.

* cited by examiner

DRILLING RIGS AND ERECTION METHODS

BACKGROUND OF THE INVENTION

1. Field of the Invention

This invention is directed to drilling rigs and to methods for erecting mobile drilling rigs.

2. Description of Related Art

The prior art discloses a variety of rigs used in drilling and various wellbore operations; for example, and not by way of limitation, U.S. Pat. Nos. 3,340,938; 3,807,109; 3,922,825; 3,942,593; 4,269,395; 4,290,495; 4,368,602; 4,489,526; 4,569,168; 4,837,992; 6,634,436; 6,523,319; and 7,306,055 and the references cited in these patents—all these patents incorporated fully herein for all purposes. The prior art discloses a variety of systems and methods for assembling and erecting a drilling rig; for example, and not by way of limitation nor as an exhaustive listing, the disclosures in U.S. Pat. Nos. 2,993,570; 3,201,091; 3,262,237; 3,749,183; 4,221,088; 4,269,009; 4,292,772; 4,305,237; 4,478,015; 4,587,778; 4,630,425; and 4,932,175.

Often drilling rigs and related systems, structures, equipment, and apparatuses are delivered to a site, assembled, raised, disassembled, and transported to a new site. It is important that drilling rigs and their components be easily transported, assembled, and erected.

In many prior rigs and erection methods, rig components and structures used with a rig are raised by a crane and positioned on a rig's drill floor. Various problems and disadvantages are associated with using a crane. A crane is typically a large apparatus which is transported to a drilling site where it is assembled and/or made ready for lifting and locating rig components.

BRIEF SUMMARY OF THE INVENTION

The present invention, in certain aspects, provides a drilling rig with structure manipulation and erection apparatus and methods for using such apparatus to erect a rig without using a crane, without winching up cables, and without lifting items and equipment with a drawworks.

The present invention discloses, in certain aspects, a method for assembling a drilling rig, the method including: assembling a substructure of a drilling rig, the assembly including connecting an upper box to a lower box, the upper box having an upper open space, the lower box having a lower open space, and the upper open space above the lower open space; moving with a vehicle on ground a floor section connected to and supported by the vehicle into open space including the upper open space and the lower open space; and securing the floor section to the substructure.

The present invention discloses, in certain aspects, a method for assembling a drilling rig, the method including: assembling a substructure of a drilling rig, the assembly including connecting an upper box to a lower box, the upper box having an upper open space, the lower box having a lower open space, and the upper open space above the lower open space; moving with a vehicle on ground a floor section connected to and supported by the vehicle into open space including the upper open space and the lower open space; and securing the floor section to the substructure; disconnecting the floor section from the vehicle; moving the vehicle away from the drilling rig; installing a drawworks (or other rig apparatus) on the substructure; assembling a mast connected to the substructure; erecting the mast on the substructure; installing a rig structure on the substructure; and raising with raising apparatus the substructure to an operational height.

The present invention discloses, in certain aspects, a system for drilling including: a substructure, the substructure locatable on ground and having an open space; a floor section, the floor section movable with a vehicle on ground adjacent the substructure, the floor section connected to and supported by the vehicle and movable on the vehicle into the open space; and the floor section releasably connected to the substructure.

The present invention discloses, in certain aspects, a substructure for a drilling rig, the substructure including: an upper box with an upper open space; a lower box with a lower open space; the upper open space above the lower open space and comprising a substructure space; the substructure space sized for selective receipt therein of a vehicle; and a floor section connectable to and supportable by the vehicle for movement into the substructure space, the floor section connected to the substructure.

Accordingly, the present invention includes features and advantages which are believed to enable it to advance drilling rig technology and rig erection technology. Characteristics and advantages of the present invention described above and additional features and benefits will be readily apparent to those skilled in the art upon consideration of the following detailed description of preferred embodiments and referring to the accompanying drawings.

Certain embodiments of this invention are not limited to any particular individual feature disclosed here, but include combinations of them distinguished from the prior art in their structures, functions, and/or results achieved. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

What follows are some of, but not all, the objects of this invention. In addition to the specific objects stated below for at least certain preferred embodiments of the invention, there are other objects and purposes which will be readily apparent to one of skill in this art who has the benefit of this invention's teachings and disclosures. It is, therefore, an object of at least certain preferred embodiments of the present invention to provide the embodiments and aspects listed above and:

New, useful, unique, efficient, non-obvious drilling rigs; rig erection methods; and new, useful, unique, efficient, non-obvious rig structure for rig erection; and Such systems and methods in which a central drill floor portion is connected to a drill floor without a crane.

The present invention recognizes and addresses the problems and needs in this area and provides a solution to those problems and a satisfactory meeting of those needs in its various possible embodiments and equivalents thereof. To one of skill in this art who has the benefits of this invention's realizations, teachings, disclosures, and suggestions, various purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later attempt to disguise it by variations in form or additions of further improvements.

The Abstract that is part hereof is to enable the U.S. Patent and Trademark Office and the public generally, and scientists, engineers, researchers, and practitioners in the art who are not familiar with patent terms or legal terms of phraseology to determine quickly from a cursory inspection or review the nature and general area of the disclosure of this invention. The Abstract is neither intended to define the invention, which is done by the claims, nor is it intended to be limiting of the scope of the invention or of the claims in any way.

It will be understood that the various embodiments of the present invention may include one, some, or all of the disclosed, described, and/or enumerated improvements and/or technical advantages and/or elements in claims to this invention.

BRIEF DESCRIPTION OF THE SEVERAL VIEWS OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or equivalent embodiments.

Figure 1A:
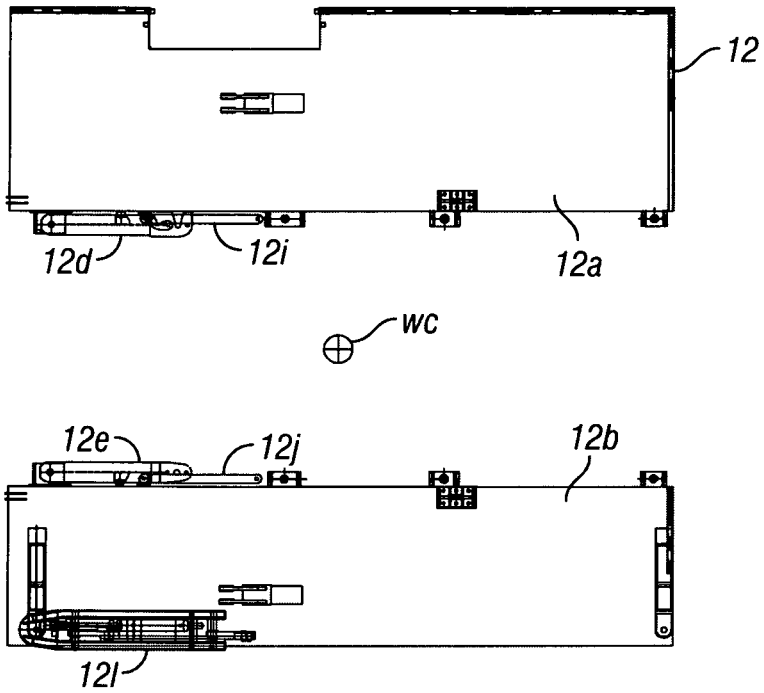
FIG. 1A is a top view of part of an upper box of a drilling rig according to the present invention.

Presently preferred embodiments of the invention are shown in the above-identified figures and described in detail below. Various aspects and features of embodiments of the invention are described below and some are set out in the dependent claims. Any combination of aspects and/or features described below or shown in the dependent claims can be used except where such aspects and/or features are mutually exclusive. It should be understood that the appended drawings and description herein are of preferred embodiments and are not intended to limit the invention or the appended claims. On the contrary, the intention is to cover all modifications, equivalents and alternatives falling within the spirit and scope of the invention as defined by the appended claims. In showing and describing the preferred embodiments, like or identical reference numerals are used to identify common or similar elements. The figures are not necessarily to scale and certain features and certain views of the figures may be shown exaggerated in scale or in schematic in the interest of clarity and conciseness.

As used herein and throughout all the various portions (and headings) of this patent, the terms "invention", "present invention" and variations thereof mean one or more embodiment, and are not intended to mean the claimed invention of any particular appended claim(s) or all of the appended claims. Accordingly, the subject or topic of each such reference is not automatically or necessarily part of, or required by, any particular claim(s) merely because of such reference. So long as they are not mutually exclusive or contradictory any aspect or feature or combination of aspects or features of any embodiment disclosed herein may be used in any other embodiment disclosed herein.

DETAILED DESCRIPTION OF THE INVENTION

FIGS. 6A-6D show a rig 10 according to the present invention erected by a method according to the present invention.

Figure 1B:
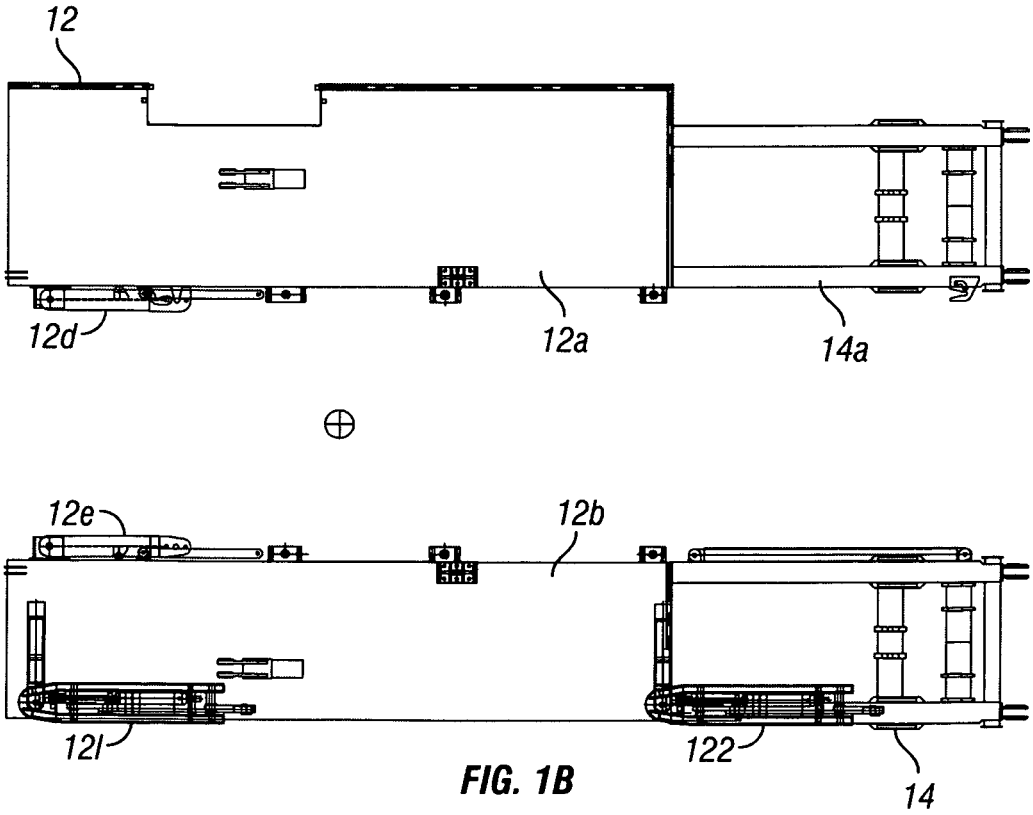
FIG. 1B is a top view of the upper box of FIG. 1A above a base box of the rig according to the present invention.

FIG. 1A shows an upper box 12 of a substructure 20 or the rig 10 according to the present invention. FIG. 1B shows the upper box 12 above a base box 14 of the rig substructure 20. The upper box 12 includes side floor section 12*a*, side floor section 12*b*, upper box beam 12*c* which includes parts 12*d* and 12*e*. The parts 12*d* and 12*e* pivot, respectively, about pivot connections 12*f*, 12*g* and these have ends which are releasably connectable to each other with a pin 12*h* as shown in FIG. 1D. Braces 12*i*, 12*j* are pivotably connected to pivot connections 12*k*, 12*m*, respectively and are pivotable to releasably connect to the parts 12*d*, 12*e* at points 12*n*, 12*p*, respectively, as shown in FIG. 1D. Optionally, the rig 10 has pivotable suspension arms 121, 122 which are useful in securing an item, e.g. a rig structure such as a doghouse DH (see FIG. 6F) to the rig.

The base box 14 includes a side structure 14*a* and a side structure 14*b*; a base box beam 14*c*; a base box beam 14*d*; a base box beam 14*e*; a substructure raising cylinder 14*f*; and a substructure raising cylinder 14*g*.

Figure 1C:
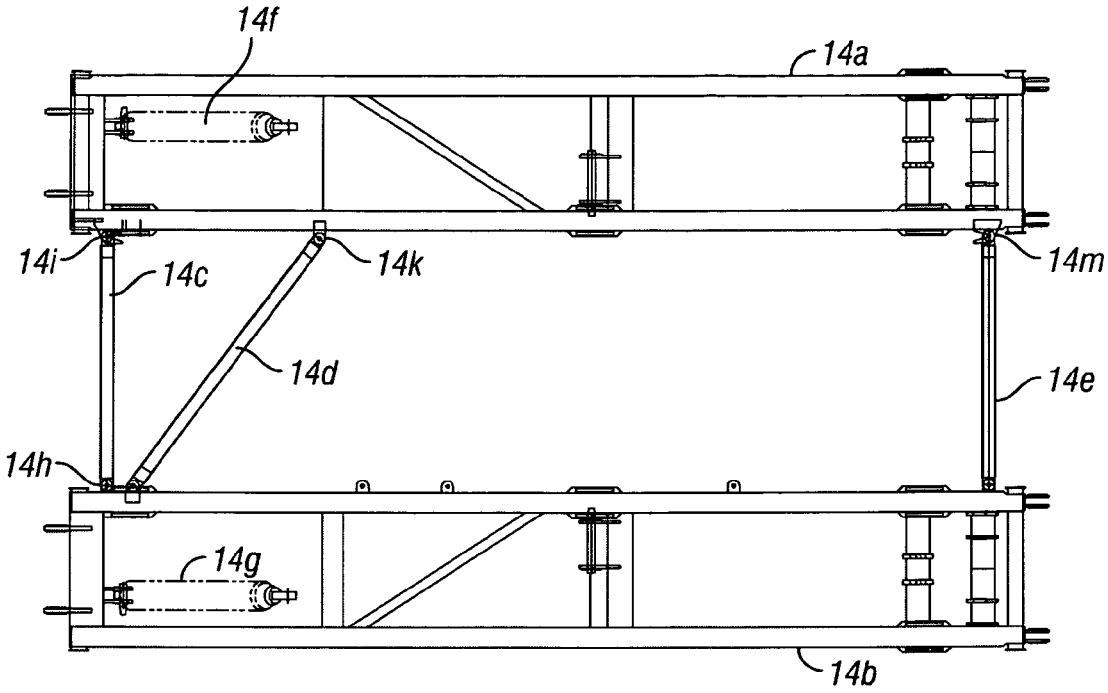
FIG. 1C is a top view of base box of FIG. 1B.
Figure 1D:
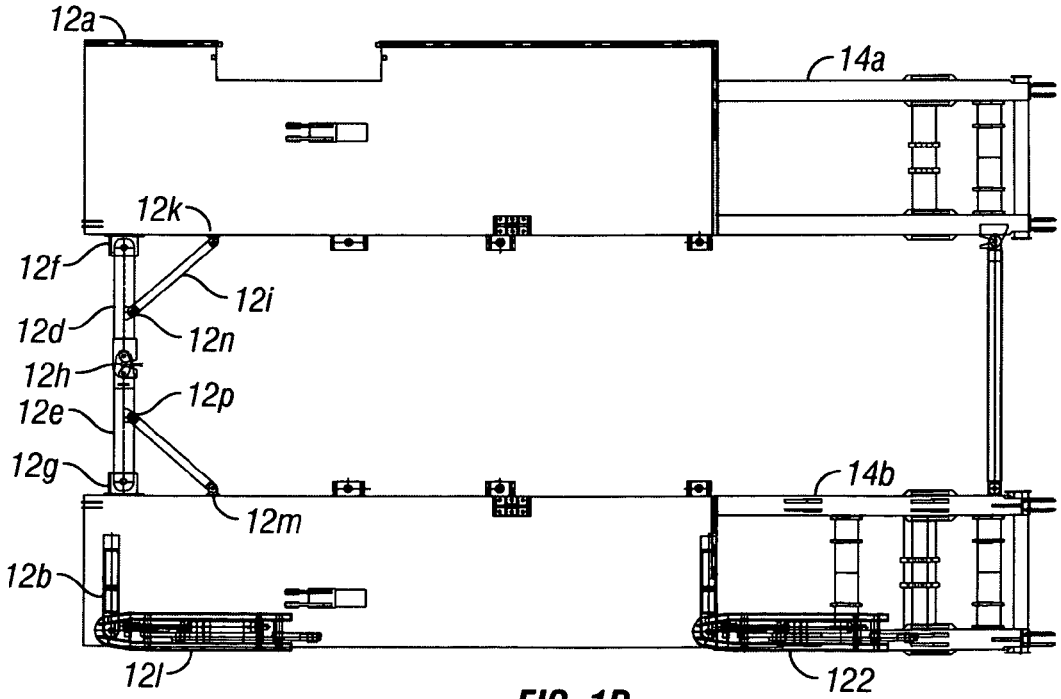
FIG. 1D is an top view of the upper box and of the base box of FIG. 1B.

As shown in FIG. 1C, the base box beam 14*c* has been pivoted about a pivotal connection 14*h* and releasably connected to a connection 14*i* on the side structure 14*a*. The base box beam 14*d* has been pivoted about a pivotal connection 14*i* and releasably connected to a connection 14*k* on the side structure 14*a*. The base box beam 14*e* has been pivoted about a pivotal connection 14*m* and releasably connected to a connection 14*n* on the side structure 14*a*. This releasably connects the base side structure 14*a* to the base side structure 14*b* with respect to a well center WC.

As shown in FIG. 1D, the parts 12*d*, 12*e* of the upper box beam 12*c* have been pivoted and their ends have been releasably connected with the pin 12*h*. The braces 12*i*, 12*j* have been pivoted and connected to the parts 12*d*, 12*e*, respectively.

The combination of the upper box 12 and the base box 14 form the basic structure of the rig substructure 20.

FIGS. 2A-2D illustrate the installation of a drawworks 16 on the substructure 20. It is within the scope of the present invention for the drawworks 16 to be installed on the substructure 20 in any known way using any known structure, apparatus, machines and devices; and using any known drill floor and/or upper box, including, but not limited to, an upper box with a floor portion for supporting the drawworks. Alternatively, the drawworks 16 is installed as described in the U.S. Patent Application filed on even date herewith, naming Donnally et al as inventors, and entitled "Drilling Rig Drawworks Installation"; co-owned with the present invention and incorporated fully herein for all purposes. FIGS. 2A-2D illustrate one drawworks installation method.

Figure 2A:
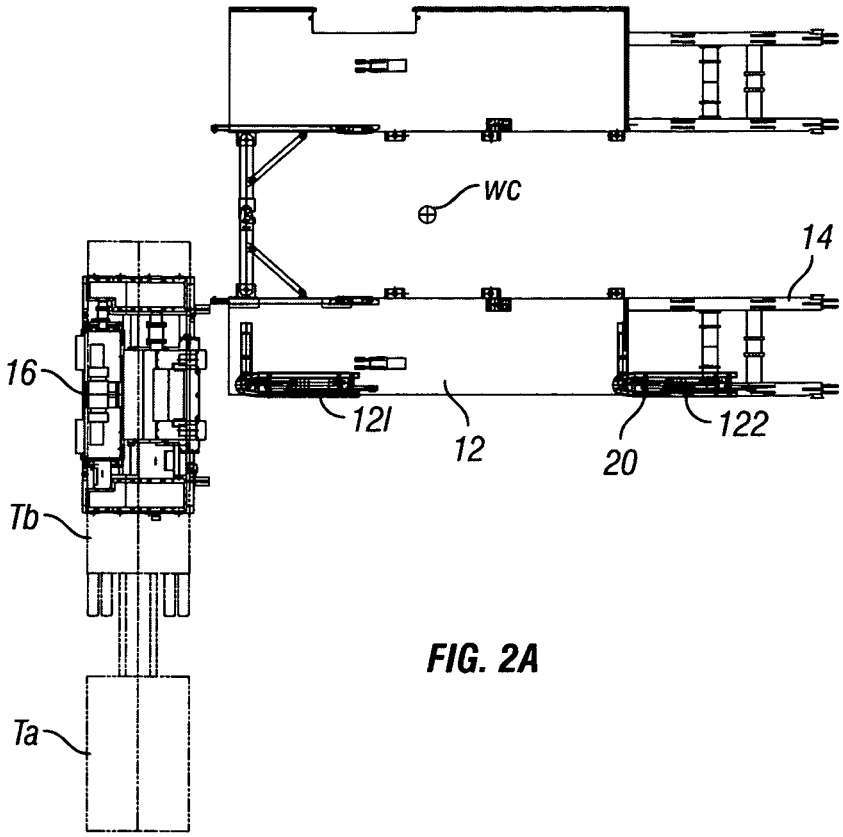
FIG. 2A is a top view of a step in a method for the assembly of rig according to the present invention for installing a drawworks.
Figure 2B:
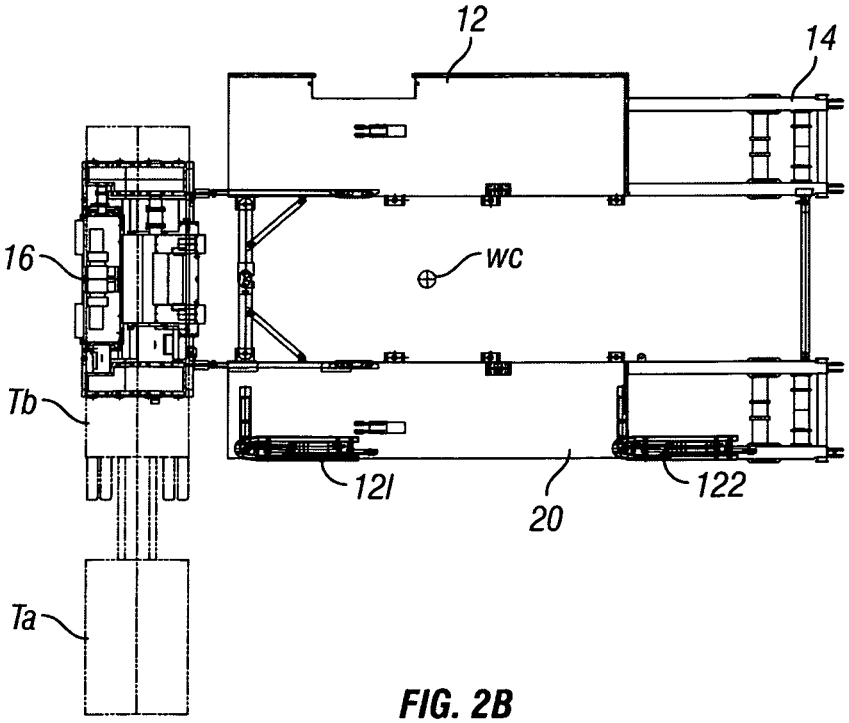
FIG. 2B is a top view of a further step in the assembly method for the assembly of rig according to the present invention.
Figure 2C:
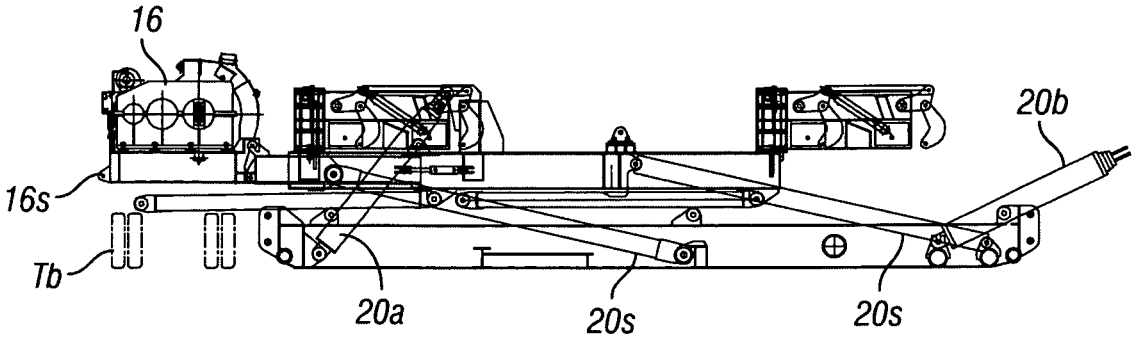
FIG. 2C is a side view of the step of FIG. 2B.
Figure 2D:
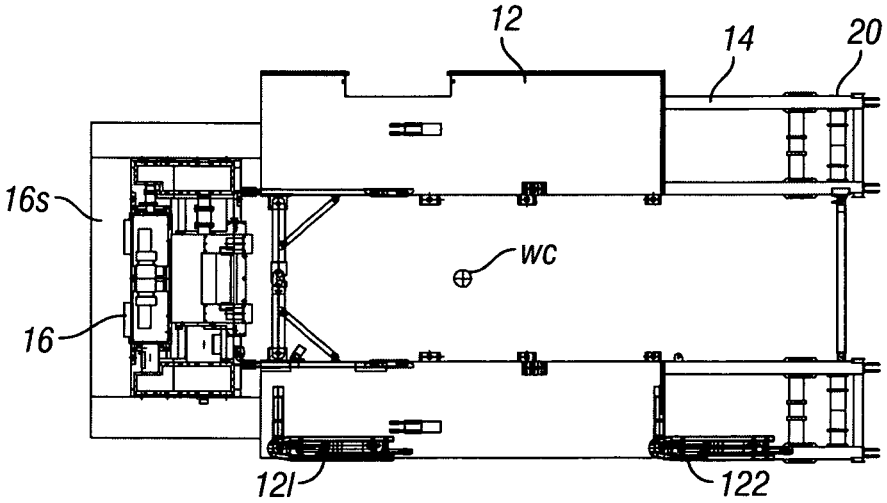
FIG. 2D is a top view showing the drawworks installed on the rig.

As shown in FIG. 2A a truck Ta with a trailer Tb pulls alongside the substructure 20. The trailer Tb supports the drawworks 16 which is on a skid 16*s*. As shown in FIGS. 2B and 2C the truck Ta positions the trailer Tb in a desired position with respect to the substructure 20 and the skid 16*s* of the drawworks 16 is connected to the substructure 20. Alternatively the upper box 12 includes a support floor for the drawworks 16. The substructure 20 includes pivotable supports 20*s*, substructure raising cylinder apparatuses 20*a*, and mast raising cylinder apparatuses 20*b*.

FIGS. 3A-3D illustrate the installation of a mast 18 on the substructure 20 and the raising of the mast 18. It is within the scope of the present invention to install any suitable known mast on the substructure 20 and to install the mast using any known method and apparatus. Alternatively, the mast 18 is installed as described in the U.S. patent application Ser. No. 12/074,258 co-owned with the present invention, naming Donnally et al as inventors, filed on even date herewith, and entitled "Drilling Rig Masts And Methods of Assembly and Erecting Masts"; and incorporated fully herein for all purposes. FIGS. 3A-3D illustrate one mast installation method. The rig shown includes a doghouse support arm 18*t*.

Figure 3A:
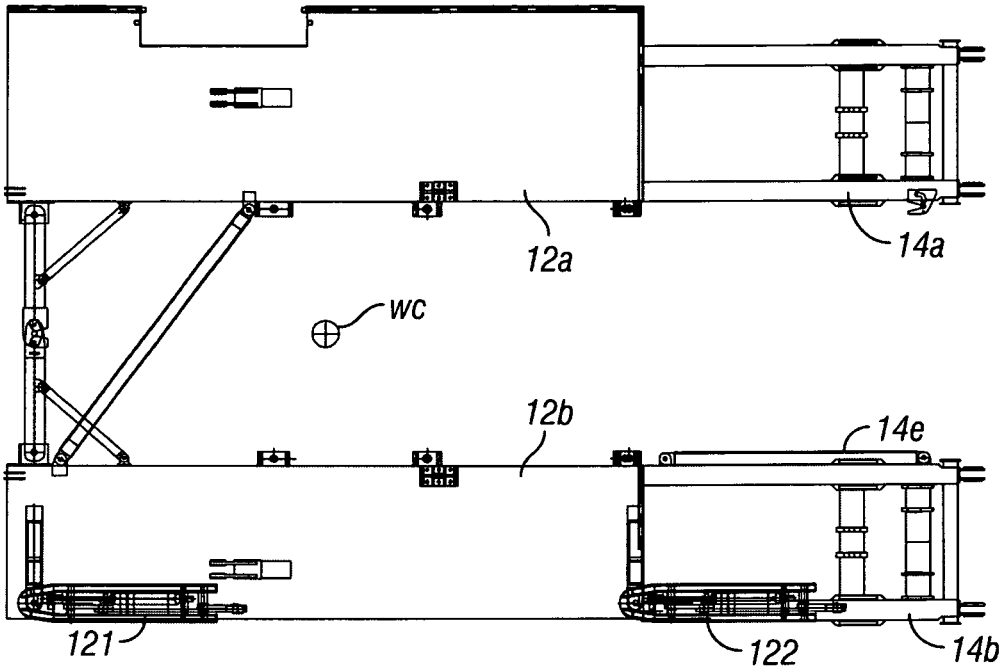
FIG. 3A is a top view of a step in a method for the assembly of rig according to the present invention for installing a mast.
Figure 3B:
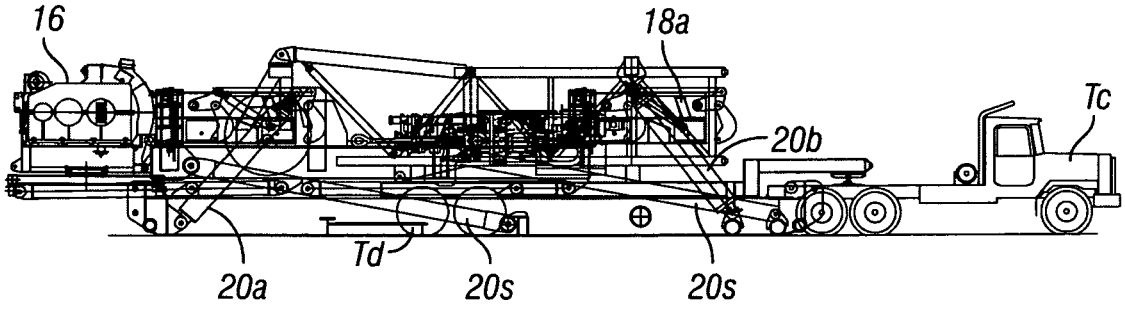
FIG. 3B is a side view of a further step in the assembly method for installing the mast.

As shown in FIG. 3A, the substructure 20 has been lowered using the substructure cylinder apparatuses 14*f*, 14*g* and the base box beam 14*e* has been disconnected from the connection 14*n* and pivoted out of the way making room for part of the mast to be moved into place between the side structures 14*a*, 14*b*. Legs 20*a* are pivotably connected to the substructure. As shown in FIG. 3B a truck Tc with a trailer Td supporting a bottom mast section 18*a* has moved the bottom mast section 18*a* between the side structures 14*a*, 14*b*. The mast raising cylinder apparatuses 20*b* are connected to the mast bottom section 18*a* and both the substructure raising cylinder apparatuses 14*f*, 14*g* and the mast raising cylinder apparatuses 20*b* are then extended to raise the mast bottom section 18*a* above the trailer Td. The truck Tc is then moved away.

Figure 3C:
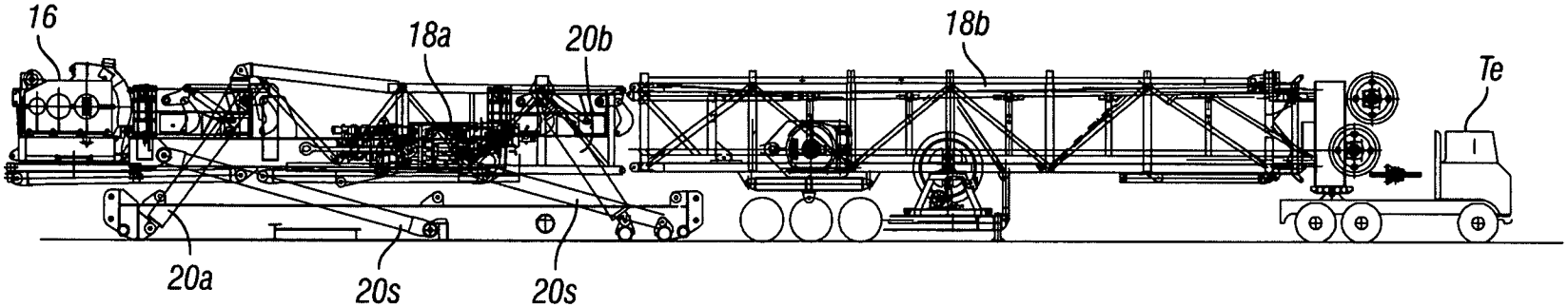
FIG. 3C is a side view of a further step in installing the mast.

As shown in FIG. 3C, with the bottom mast section 18*a* connected to the upper box 12 a truck Te with a trailer Tf supporting a mid mast section 18*b* has moved the mid mast section 18*b* adjacent the bottom mast section 18*a*.

Figure 3D:
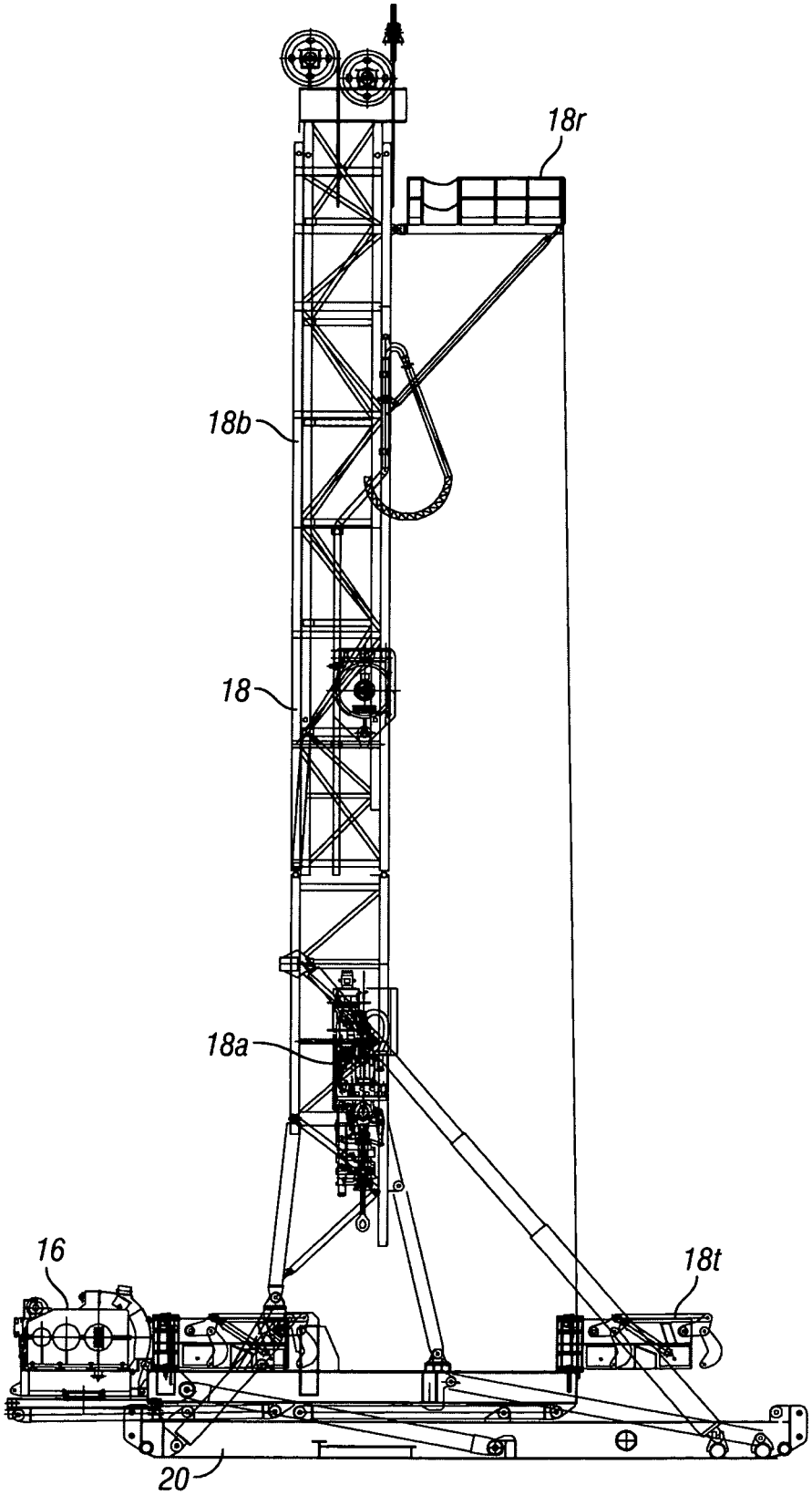
FIG. 3D shows the mast erected.

The bottom mast section 18*a* is connected to the mid mast section 18*b*; in one aspect, employing the substructure raising cylinder apparatuses 14*f*, 14*g* and the mast raising cylinder apparatuses 20*b* to position the mast sections and facilitate their interengagement. The truck Te is then moved away; in one aspect, the truck Te is moved away following retraction of the substructure raising cylinder apparatuses 14*f*, 14*g*, and extension of the mast raising cylinder apparatuses 20*b*. As shown in FIG. 3D, but prior to erecting the mast 18, a racking board 18*r* may be opened on the mast 18.

As shown in FIG. 3D, the mast 18 is erected, e.g., by extending the mast raising cylinder apparatuses. The mast bottom section 18*a* is secured to the mast mid section 18*b* and, if used, the mast raising cylinder apparatuses are then retracted.

FIGS. 4A-4E illustrate a method according to the present invention for the installation of a center floor section 19.

Figure 4A:
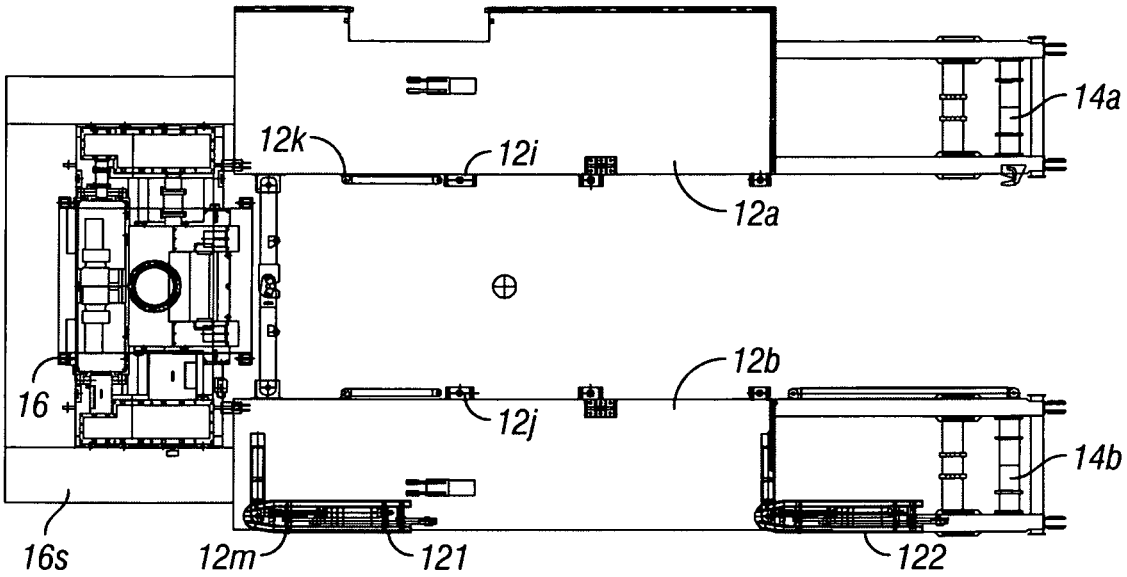
FIG. 4A is a top view of a step in a method for the assembly of rig according to the present invention for installing a center floor on the rig.
Figure 4B:
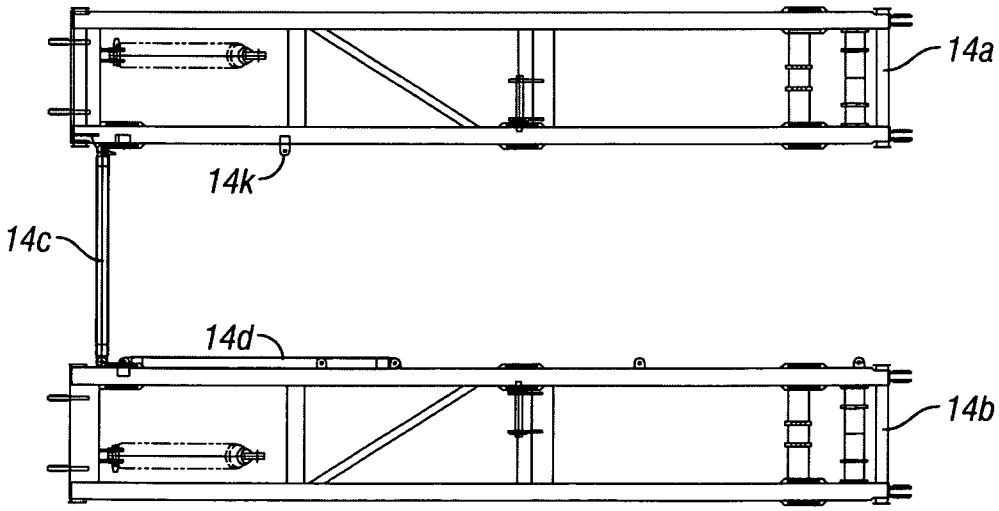
FIG. 4B is a top view of a further step in the assembly method for installing the center floor.

As shown in FIG. 4A, the braces 12*i*, 12*j* have been released from the parts 12*d*, 12*e*, respectively, pivoted on their respective connections 12*k*, 12*m*; and moved out of the way. As shown in FIG. 4B, the base box beam 14*d* has been released from its connection 14*k*; pivoted on its connection 14*i*; and moved out of the way.

Figure 4C:
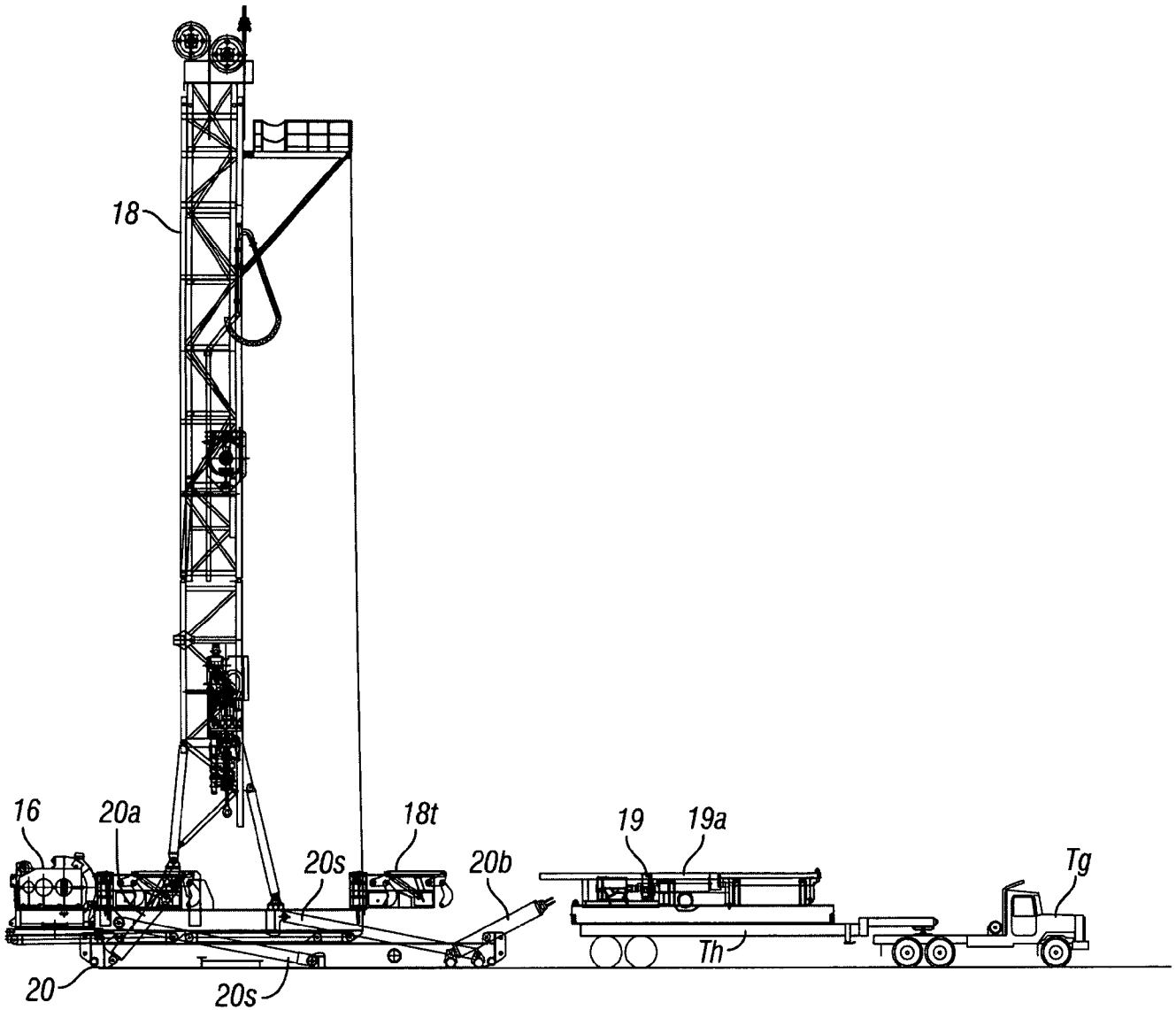
FIG. 4C is a side view of a further step in installing the center floor.
Figure 4D:
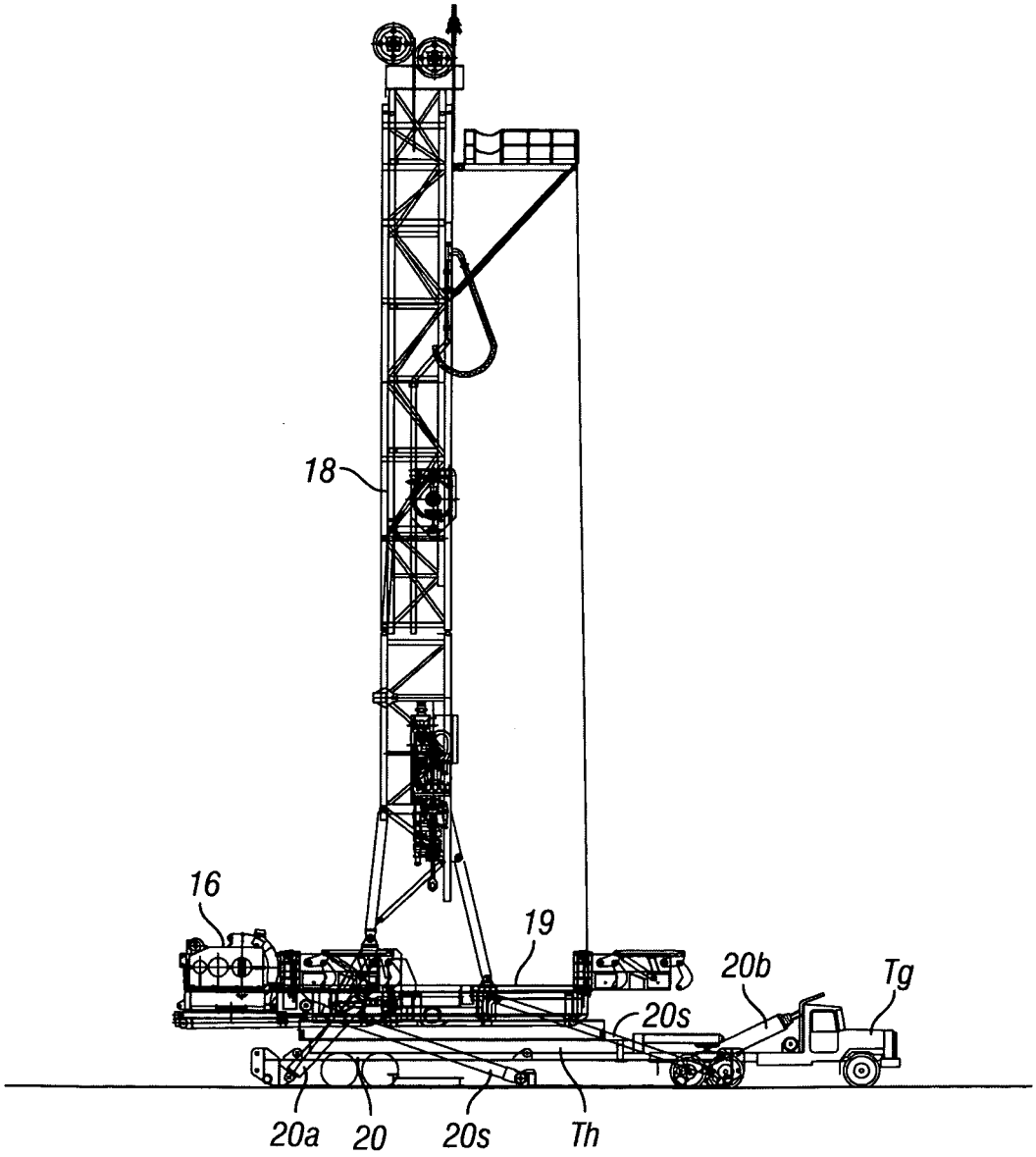
FIG. 4D is a side view of a further step in installing the center floor.
Figure 4E:
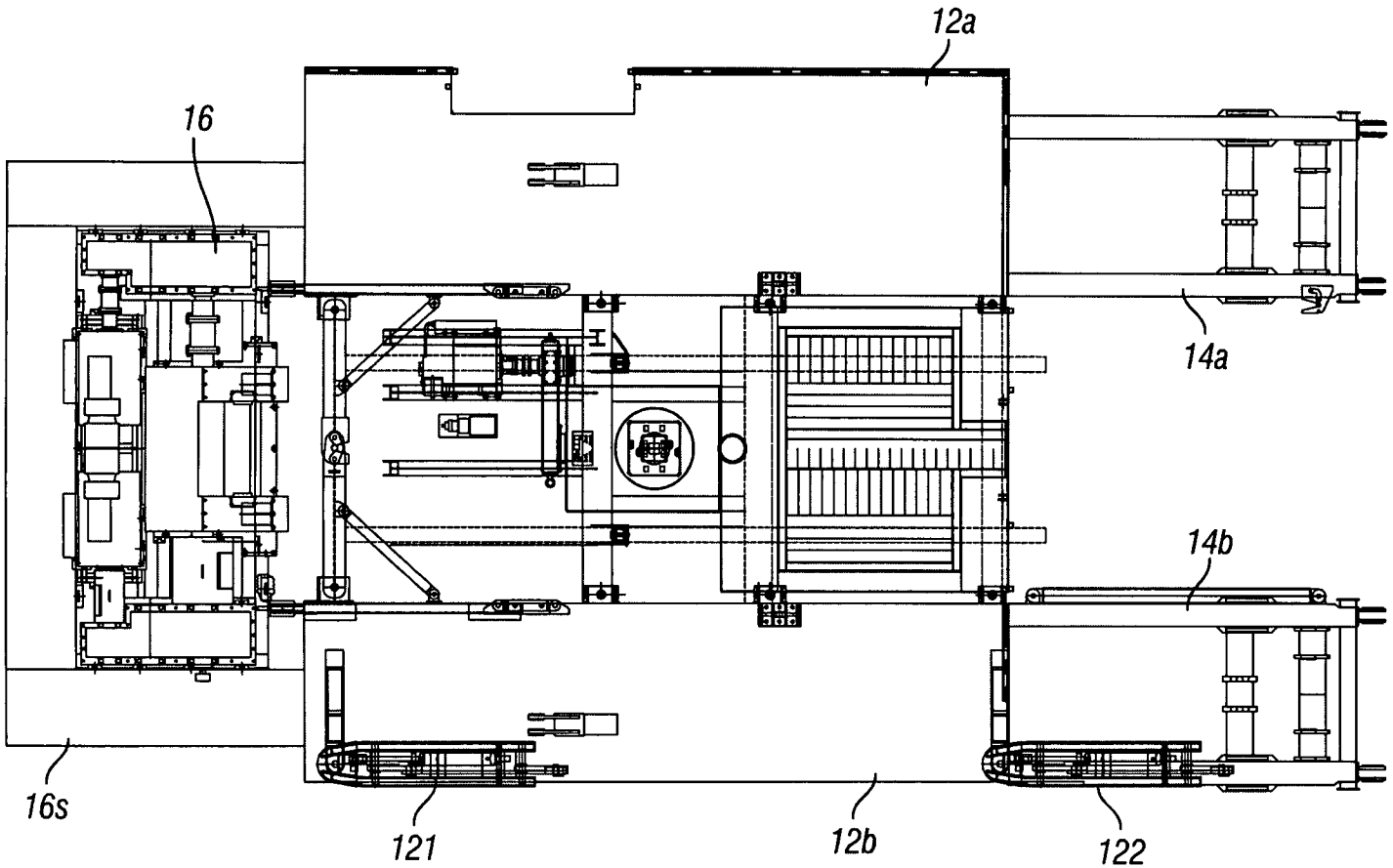
FIG. 4E is a top view of a further step in the assembly method for installing the center floor.

As shown in FIG. 4C, a truck Tg with a trailer Th supporting a center floor section 19 has moved the center floor section 19 adjacent the substructure 20. The center floor section 19, optionally, includes a rotary table 19*a*. As shown in FIG. 4D, the truck Tg moves the center floor section 19 between the parts of the upper box 12 and base box 14 and the center floor section 19 is connected to the upper box 12. The truck Tg and trailer Th are moved away. The braces 12*i*, 12*j* are then reconnected (see FIG. 4E).

FIGS. 5A-5D illustrate the installation of a rig structure (e.g. house, cabin, control room, doghouse, driller cabin) on the substructure 20. It is within the scope of the present invention to use any known apparatus and method for installing a rig structure on the substructure. Alternatively, the rig structure (e.g. a doghouse 17) is installed on the substructure 20 as described in the U.S. application Ser. No. 12/074,264 filed on even date herewith entitled "Drilling Rig Structure Installation and Methods"; co-owned with the present invention; and incorporated fully herein for all purposes.

Figure 5A:
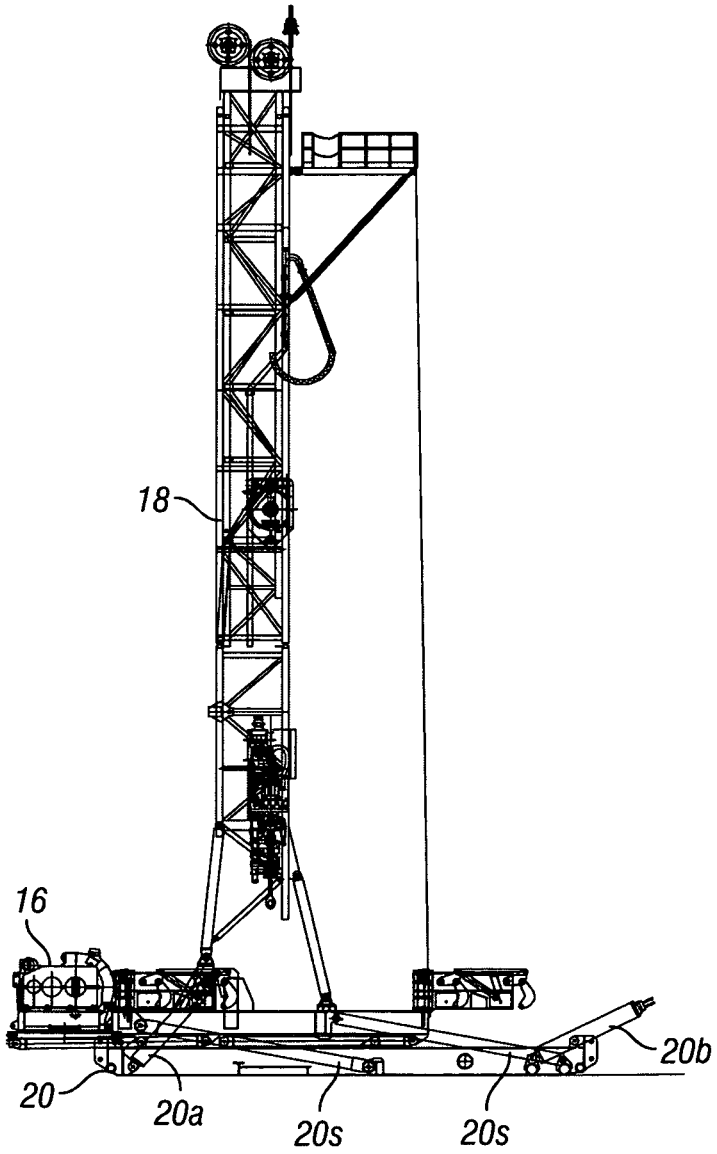
FIG. 5A is a side view of a step in a method for the assembly of rig according to the present invention for installing a rig structure, e.g., a doghouse, on the rig.
Figure 5B:
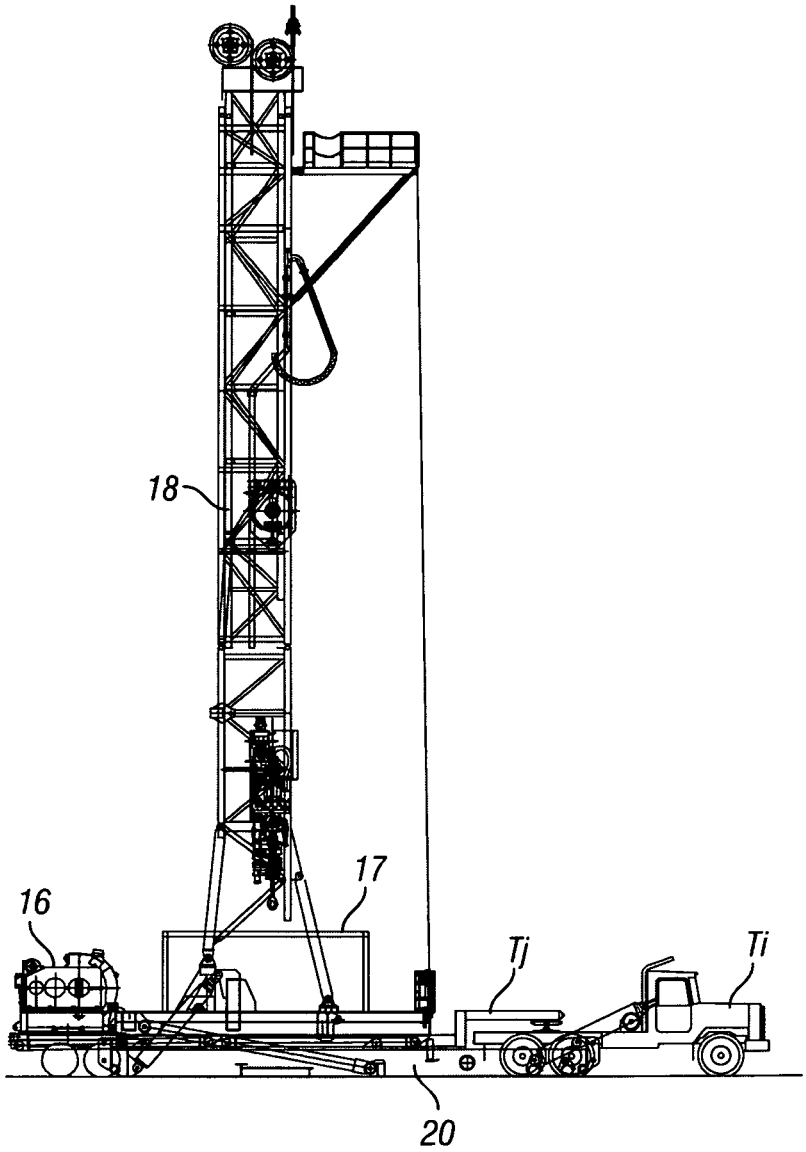
FIG. 5B is a top view of a further step in the assembly method for installing the doghouse.
Figure 5C:
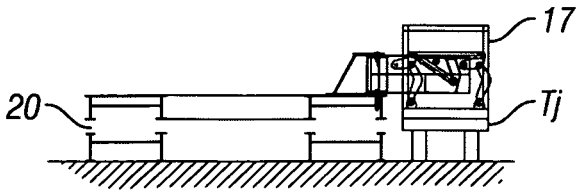
FIG. 5C is an end view of the step of FIG. 5B.
Figure 5D:
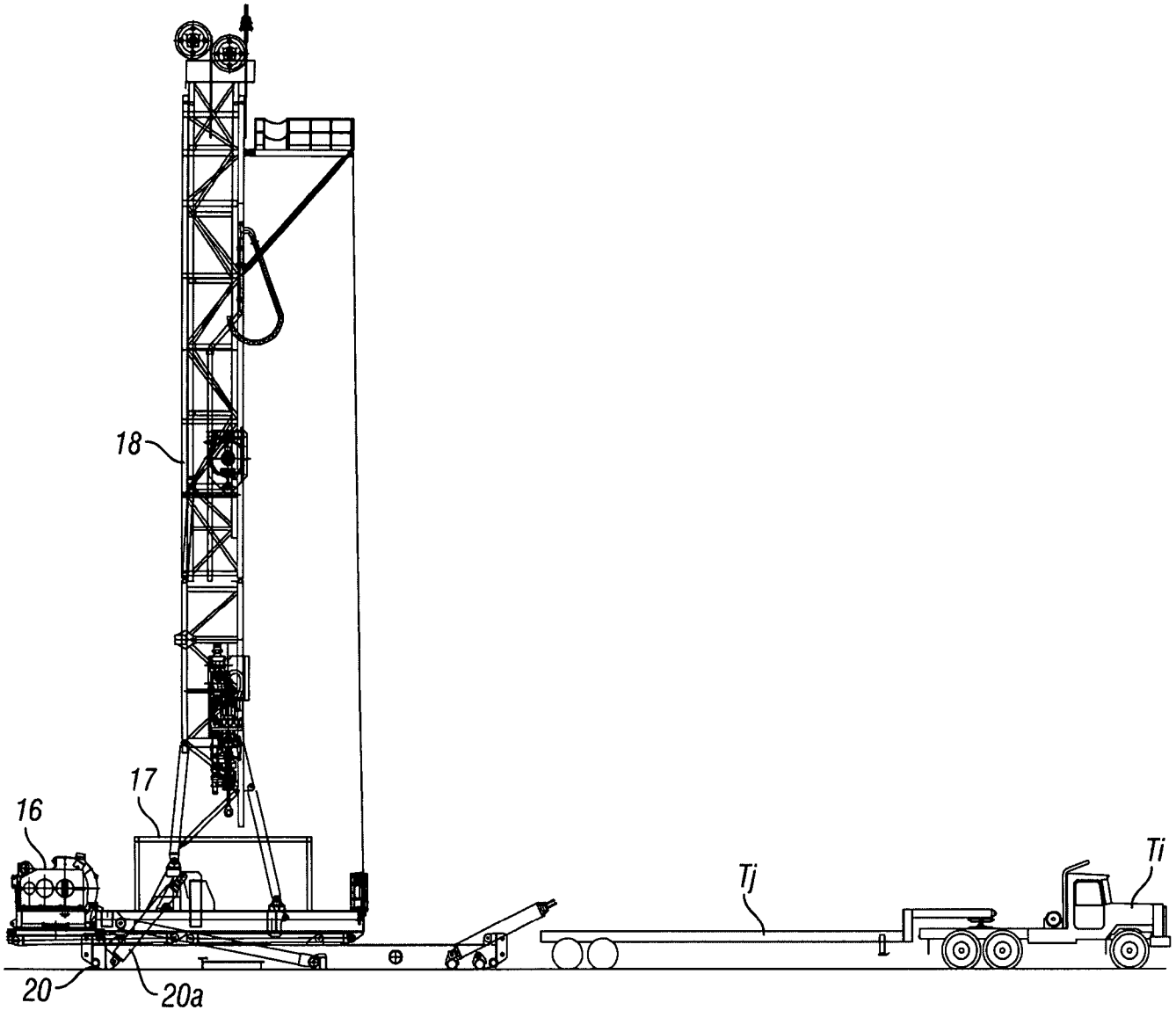
FIG. 5D is a side view of a further step in installing doghouse.

As shown in FIGS. 5A-5C, the doghouse 17 supported on a trailer Tj of a truck Ti is moved into position adjacent the substructure 20 and the substructure 20 has been lowered. The doghouse 17 is connected to the substructure 20 and the truck Ti and trailer Tj are then moved away (FIG. 5D).

FIGS. 6A-6D illustrate the raising of the substructure 20 to move the rig 10 into a working position.

Figure 6A:
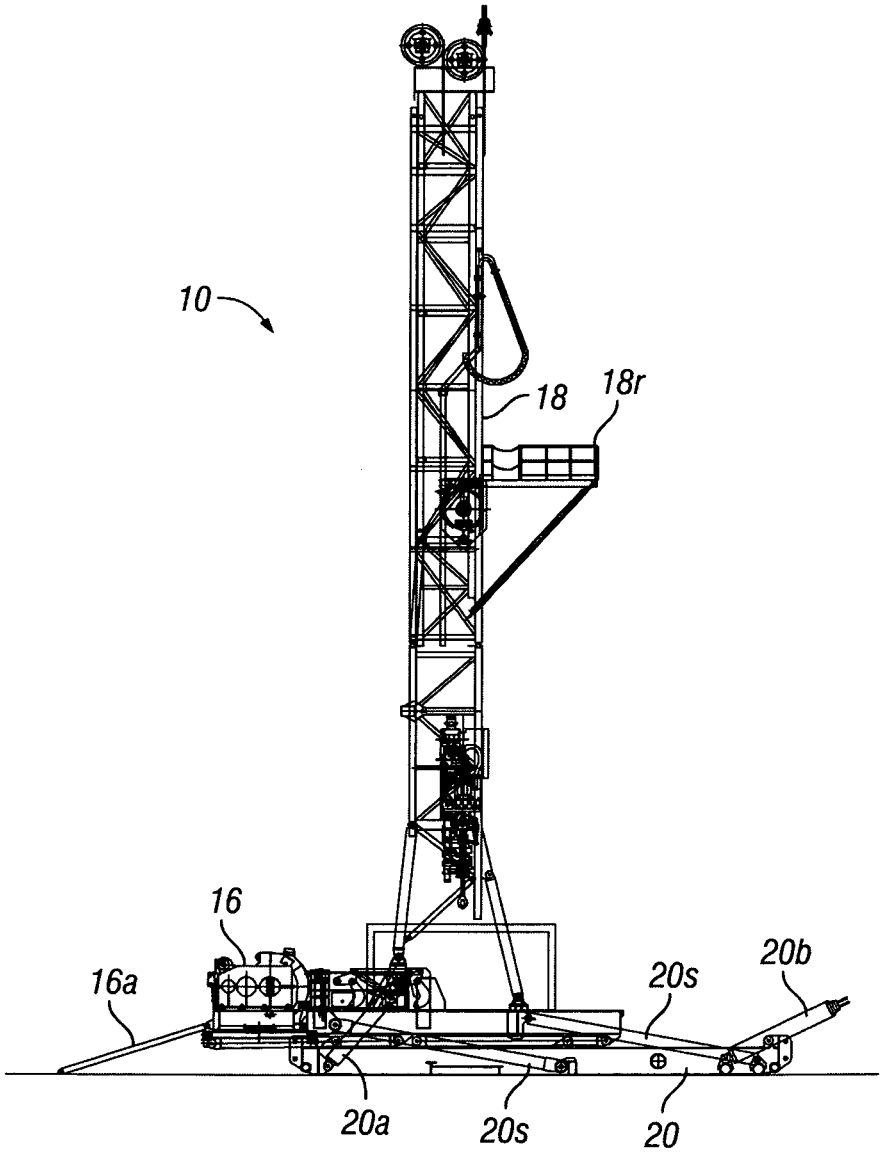
FIG. 6A is a side view of a step in a method for the assembly of rig according to the present invention for raising the rig.

As shown in FIG. 6A, the substructure 20 is lowered to install drawworks skid support legs 16*a*; various equipment and apparatuses; e.g., (see FIG. 6F) an iron roughneck 24; air tugger winches 25*a*; an independent rotary drive 25*b*; and a rotary table 25*c* (if not already installed) over a well center WC and near a mousehole MH (any of which optionally may be installed on the center section before installation on the substructure); and other equipment and hand rails.

Figure 6B:
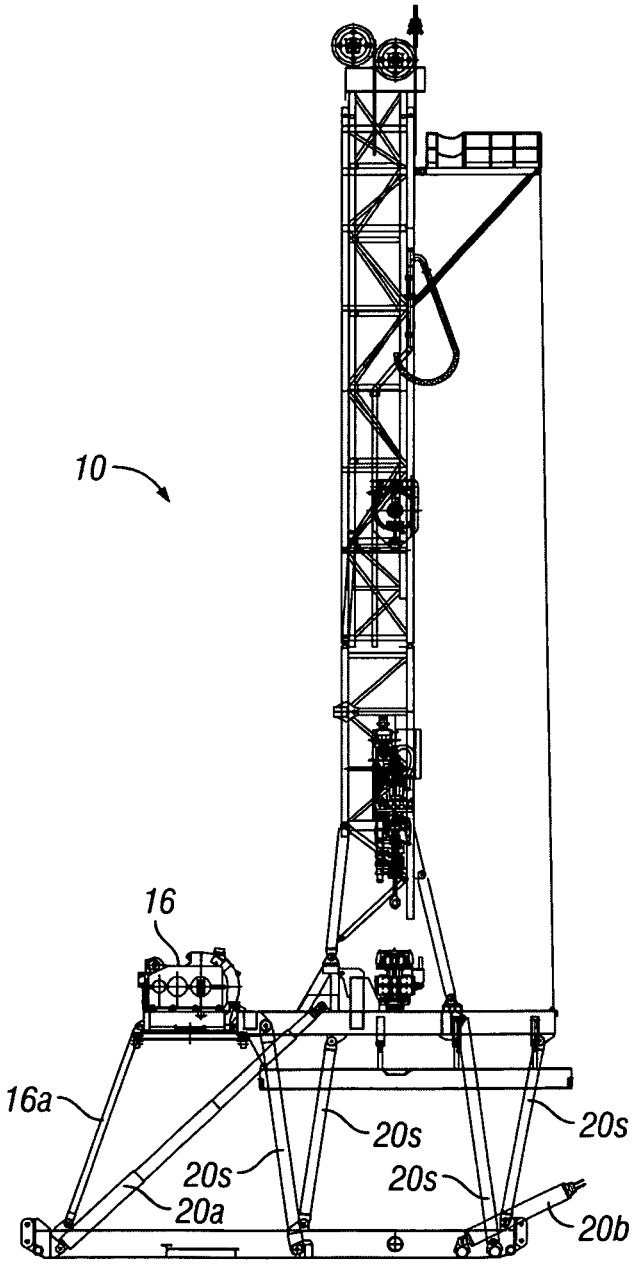
FIG. 6B is a side view of a further step in the assembly method for raising the rig.
Figure 6C:
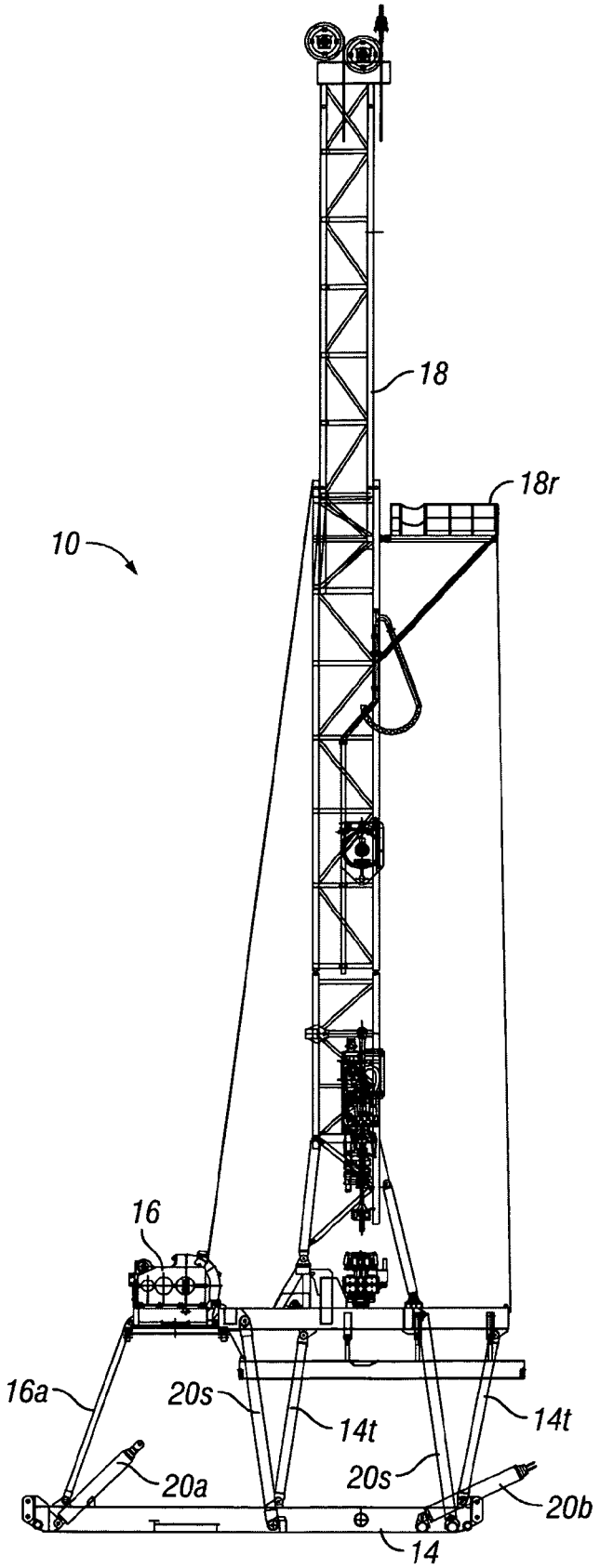
FIG. 6C is a side view of a further step in raising the rig.
Figure 6D:
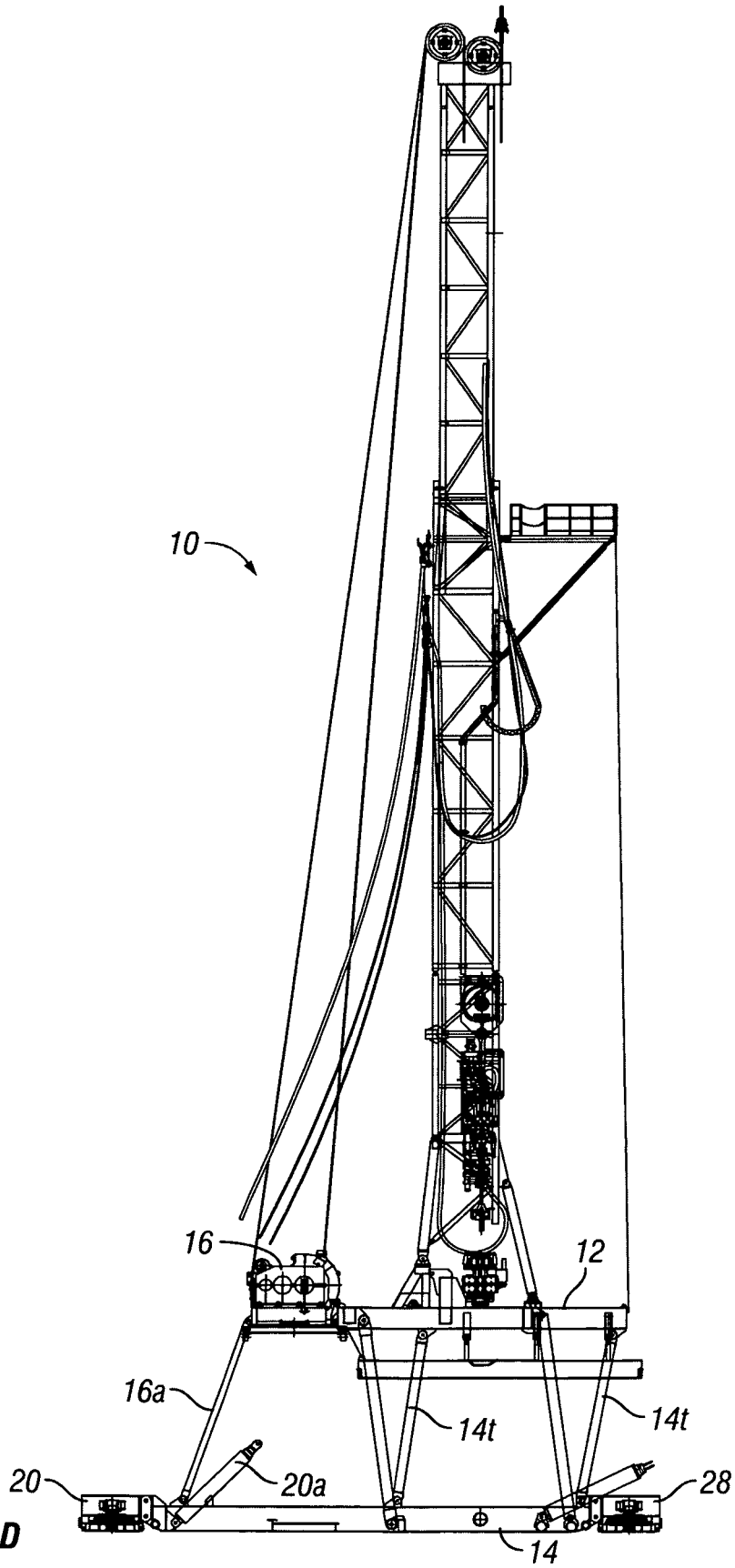
FIG. 6D is a side view of a further step in raising the rig.
Figure 6E:
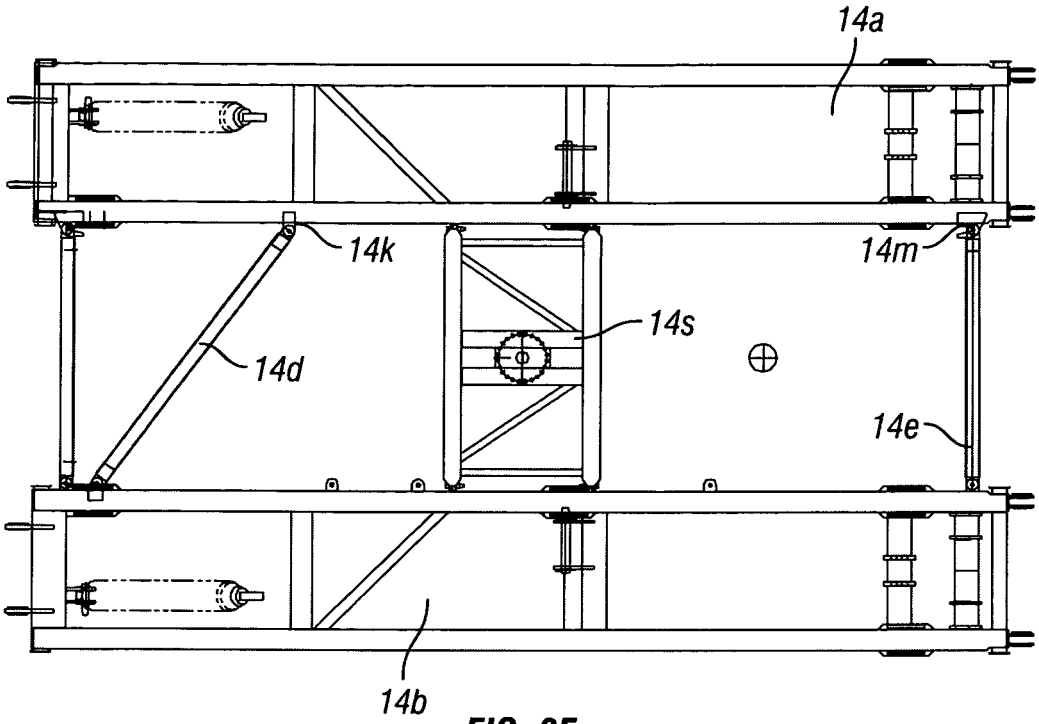
FIG. 6E is a top view of a further step in raising the rig.

As shown in FIG. 6B, the substructure 20 is raised using the substructure raising cylinder apparatuses, raising the upper box 12, the mast 18, and the other equipment. A bottom end of each of the legs 16*a* is pinned to the base box 14. The base box beams 14*d* and 14*e* are pivoted and reconnected to the connections 14*k*, 14*m*, respectively. A BOP support beam structure 14*s* is connected to the base box 14. Support legs 14*t* are connected between the upper box 12 and the base box 4. If the mast 18 is a telescoping mast, the mid mast section 18*b* is telescoped up from the bottom mast section 18*a* (FIG. 6C). As shown in FIG. 6D the rig 10 is erected and, optionally, a rig walker 28 (for rig movement) is installed on the base box 14.

Figure 6F:
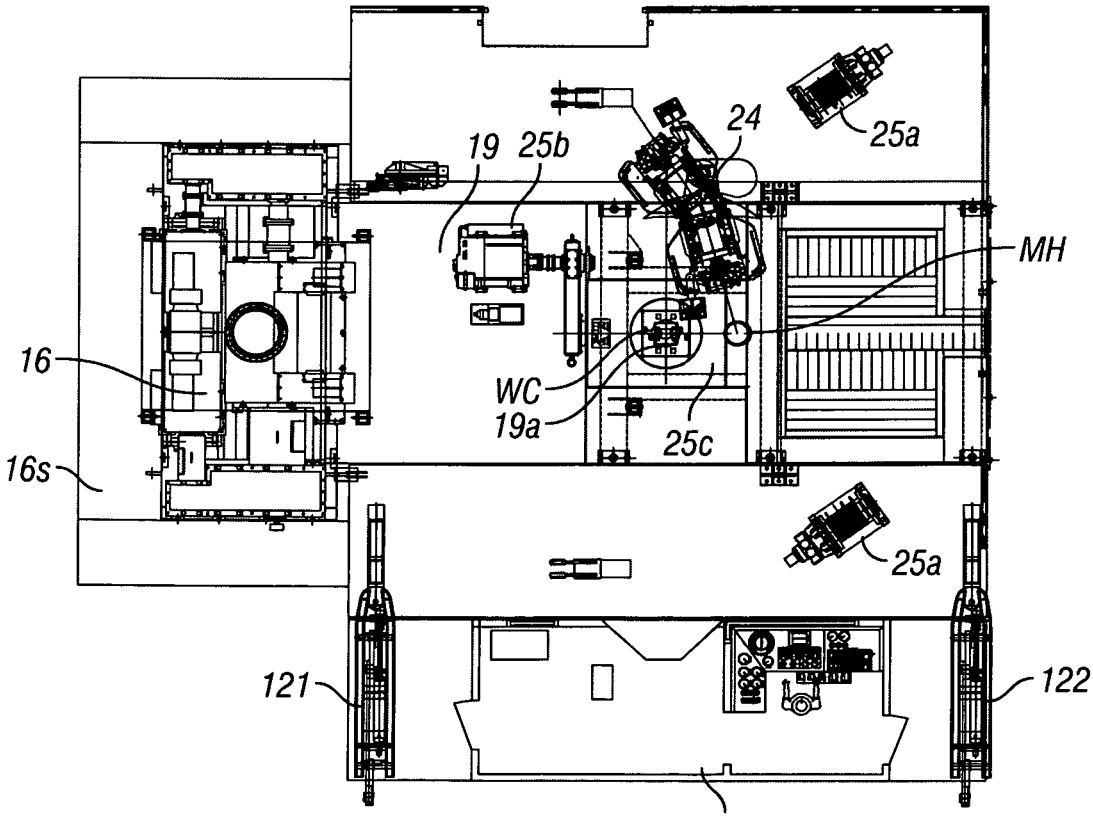
FIG. 6F is a top view of the rig floor of the rig of FIG. 6D.

FIG. 6F is a top view of the upper box 12 with the drawworks 16, doghouse 17, and center floor 19 installed.

FIGS. 7A-7F illustrate structure for connection of various parts of the rig as in FIG. 6F; shown with a drawworks deleted.

FIGS. 7A-7F illustrate various connection structures both before the center floor 19 is installed and after the center floor 19 is installed.

Figure 7A:
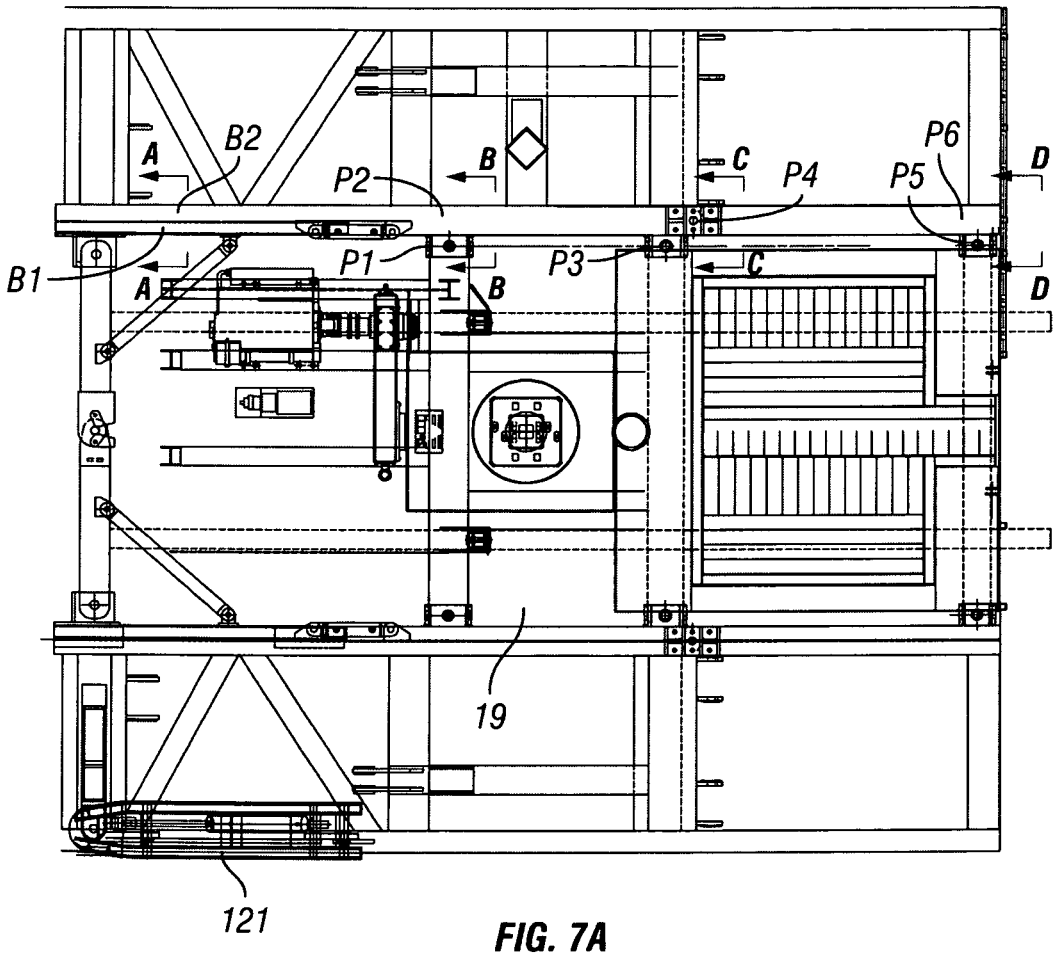
FIG. 7A is a top view of part of a rig as in FIG. 6F.
Figure 7B:
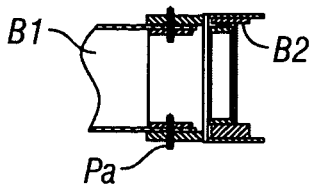
FIG. 7B is a side view showing a connection of parts of the rig of FIG. 7A after installation and FIG. 7B is a view along-line-A-A of FIG. 7A.
Figure 7C:
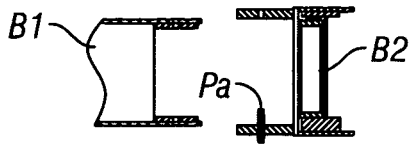
FIG. 7C is a side view showing a connection of parts of the rig of FIG. 7A before installation.

FIGS. 7B-7C illustrate the connection of beams B1 and B2 with pins Pa.

Figure 7D:
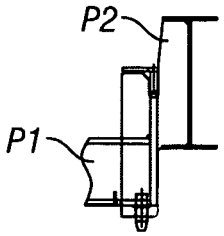
FIG. 7D is a side view showing a connection of parts of the rig of FIG. 7A after installation and FIG. 7D is a view along line B-B of FIG. 7A.
Figure 7E:
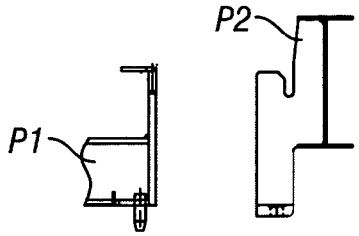
FIG. 7E is a side view showing a connection of parts of the rig of FIG. 7A before installation.

FIGS. 7D-7E illustrate the connection of parts P1 and P2.

Figure 7F:
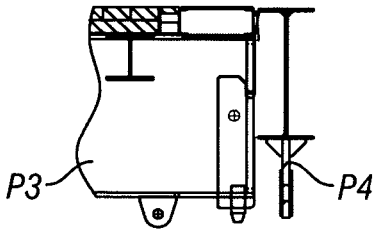
FIG. 7F is a side view showing a connection of parts of the rig of FIG. 7A after installation and FIG. 7F is a view along line C-C of FIG. 7A.
Figure 7G:
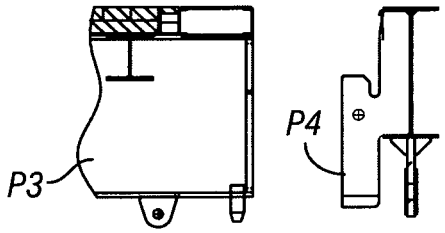
FIG. 7G is a side view showing a connection of parts of the rig of FIG. 7A before installation.

FIGS. 7G-7F illustrate the connection of parts P3 and P4.

Figure 7H:
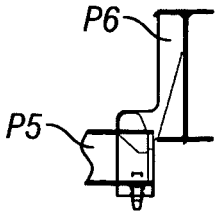
FIG. 7H is a side view showing a connection of parts of the rig of FIG. 7A after installation and FIG. 7H is a view along line D-D of FIG. 7A.
Figure 7I:
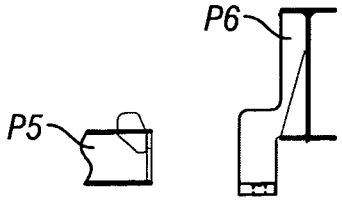
FIG. 7I is a side view showing a connection of parts of the rig of FIG. 7A before installation.

FIGS. 7H-7I illustrate the connection of parts P5 and P6.

The present invention, therefore, provides in some, but not in necessarily all, embodiments a method for assembling a drilling rig, the method including: assembling a substructure of a drilling rig, the assembly including connecting an upper box to a lower box, the upper box having an upper open space, the lower box having a lower open space, and the upper open space above the lower open space; moving with a vehicle on ground a floor section connected to and supported by the vehicle into open space including the upper open space and the lower open space; and securing the floor section to the substructure. Such a method may one or some, in any possible combination, of the following: disconnecting the floor section from the vehicle, and moving the vehicle away from the drilling rig; installing a drawworks (or rig apparatus) on the substructure; assembling a mast connected to the substructure; erecting the mast on the substructure; installing a rig structure on the substructure; wherein the rig structure is one of doghouse, cabin, and control room; installing rig equipment on the substructure; wherein the rig equipment is one of winch, iron roughneck, independent rotary table drive, and rotary table; and/or raising with raising apparatus the substructure to an operational height.

The present invention, therefore, provides in some, but not in necessarily all, embodiments a method for assembling a drilling rig, the method including: assembling a substructure of a drilling rig, the assembly including connecting an upper box to a lower box, the upper box having an upper open space, the lower box having a lower open space, and the upper open space above the lower open space; moving with a vehicle on ground a floor section connected to and supported by the vehicle into open space including the upper open space and the lower open space; and securing the floor section to the substructure; disconnecting the floor section from the vehicle; moving the vehicle away from the drilling rig; installing a drawworks (or rig apparatus) on the substructure; assembling a mast connected to the substructure; erecting the mast on the substructure; installing a rig structure on the substructure; and raising with raising apparatus the substructure to an operational height.

The present invention, therefore, provides in some, but not in necessarily all, embodiments a system for drilling including: a substructure, the substructure locatable on ground and including an upper box to a lower box, the upper box having an upper open space, the lower box having a lower open space, and the upper open space above the lower open space; a floor section, the floor section movable with a vehicle on ground adjacent the substructure, the floor section connected to and supported by the vehicle and movable on the vehicle into an open space including the upper open space and the lower open space; and the floor section releasably connected to the substructure. Such a system may one or some, in any possible combination, of the following: a drawworks (or rig apparatus) on the substructure; a mast connected to the substructure; a rig structure on the substructure; wherein the rig structure is one of doghouse, cabin, and control room; rig equipment on the substructure; wherein the rig equipment is one of winch, iron roughneck, independent rotary table drive, and rotary table; and/or raising apparatus connected to the substructure for raising the substructure to an operational height.

The present invention, therefore, provides in some, but not in necessarily all, embodiments a substructure for a drilling rig, the substructure including: an upper box with an upper open space; a lower box with a lower open space; the upper open space above the lower open space and comprising a substructure space; the substructure space sized for selective receipt therein of a vehicle; and a floor section connectable to and supportable by the vehicle for movement into the substructure space, the floor section connected to the substructure.

The systems and methods of the inventions described in the following pending U.S. Patent Applications, co-owned with the present invention, filed on even date herewith, naming Donnally et al as inventors, and fully incorporated herein for all purposes, may be used with certain embodiments of the present invention, the applications entitled: "Drilling Rig Masts And Methods Of Assembly and Erection"; "Drilling Rig Structure Installation And Methods"; and "Drilling Rig Drawworks Installation".

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to the step literally and/or to all equivalent elements or steps. The following claims are intended to cover the invention as broadly as legally possible in whatever form it may be utilized. The invention claimed herein is new and novel in accordance with 35 U.S.C. §102 and satisfies the conditions for patentability in §102. The invention claimed herein is not obvious in accordance with 35 U.S.C. §103 and satisfies the conditions for patentability in §103. This specification and the claims that follow are in accordance with all of the requirements of 35

U.S.C. §112. The inventors may rely on the Doctrine of Equivalents to determine and assess the scope of their invention and of the claims that follow as they may pertain to apparatus not materially departing from, but outside of, the literal scope of the invention as set forth in the following claims. All patents and applications identified herein are incorporated fully herein for all purposes. It is the express intention of the applicant not to invoke 35 U.S.C. §112, paragraph 6 for any limitations of any of the claims herein, except for those in which the claim expressly uses the words 'means for' together with an associated function. In this patent document, the word "comprising" is used in its non-limiting sense to mean that items following the word are including, but items not specifically mentioned are not excluded. A reference to an element by the indefinite article "a" does not exclude the possibility that more than one of the element is present, unless the context clearly requires that there be one and only one of the elements.

What is claimed is:

1. A method for assembling a drilling rig, the method comprising assembling a substructure of a drilling rig by operatively coupling an upper box to a lower box, the upper box having an upper open space, the lower box having a lower open space, wherein the upper open space is above the lower open space, installing a drawworks on the substructure by releasably coupling the drawworks to the upper box, positioning a floor section of the substructure on a vehicle and moving the vehicle on ground with the floor section positioned thereon into the upper open space and the lower open space, and releasably coupling the floor section to the upper box of the substructure.

2. The method of claim 1 further comprising disconnecting the floor section from the vehicle, and moving the vehicle away from the drilling rig.

3. The method of claim 1 further comprising assembling a mast and pivotably connecting the mast to the substructure.

4. The method of claim 3 further comprising erecting the mast on the substructure.

5. The method of claim 1 further comprising installing a rig structure on the substructure.

6. The method of claim 5 wherein the rig structure is one of a doghouse, a cabin, and a control room.

7. The method of claim 1 further comprising installing rig equipment on the substructure.

8. The method of claim 7 wherein the rig equipment is one of a winch, an iron roughneck, an independent rotary table drive, and a rotary table.

9. The method of claim 1 further comprising, after releasably coupling the drawworks and the floor section to the upper box of the substructure, raising the upper box to an operational height above the lower box.

10. A method for assembling a drilling rig, the method comprising assembling a substructure of a drilling rig by operatively coupling an upper box to a lower box, the upper box having an upper open space, the lower box having a lower open space, wherein the upper open space is above the lower open space, positioning a floor section of the substructure on a vehicle and moving the vehicle on ground with the floor section positioned thereon into the upper open space and the lower open space, securing the floor section to the upper box of the substructure, disconnecting the floor section from the vehicle, moving the vehicle away from the drilling rig, installing a drawworks on the substructure by securing the drawworks to the upper box of the substructure, assembling a mast connected to the substructure, erecting the mast on the substructure, installing a rig structure on the substructure, and raising the upper box of the substructure to an operational height above the lower box.

11. A system comprising a substructure, the substructure locatable on ground and comprising an upper box that is operatively coupled to a lower box, the upper box having an upper open space, the lower box having a lower open space, wherein the upper open space is above the lower open space and the upper box is adapted to be raised to an operational height above the lower box, a drawworks that is adapted to be secured to and raised with the upper box, and a floor section that is adapted to be secured to and raised with the upper box, wherein the floor section is further adapted to be releasably coupled to and supported by a vehicle on ground while being moved by the vehicle into the upper open space and the lower open space prior to being secured to the upper box.

12. The system of claim 11 further comprising a mast that is adapted to be pivotably connected to the substructure.

13. The system of claim 11 further comprising a rig structure that is adapted to be installed on the substructure.

14. The system of claim 13 wherein the rig structure is one of a doghouse, a cabin, and a control room.

15. The system of claim 11 further comprising rig equipment that is adapted to be installed on the substructure.

16. The system of claim 15 wherein the rig equipment is one of a winch, an iron roughneck, an independent rotary table drive, and a rotary table.

17. The system of claim 11 further comprising a raising apparatus that is operatively coupled to the substructure, wherein the raising apparatus is adapted to raise the upper box of the substructure to said operational height.

18. A substructure for a drilling rig, the substructure comprising an upper box with an upper open space, a lower box with a lower open space, wherein the lower box is operatively coupled to the upper box, the upper open space is positioned above the lower open space, and the upper and lower spaces comprise a substructure space that is adapted to receive a vehicle, a floor section that is adapted to be releasably coupled to and supported by the vehicle during movement of said vehicle into the substructure space, wherein the floor section is further adapted to be releasably coupled to the upper box of the substructure and to be raised with the upper box to an operational height above the lower box, and a plurality of drawworks connections that are adapted to releasably couple a drawworks apparatus to the upper box and to support the drawworks while the upper box is raised to said operational height.

19. The system of claim 11 wherein said floor section and said drawworks are adapted to be releasably coupled to said substructure.

20. The system of claim 11 wherein the upper box comprises a first upper side box and a second upper side box and the lower box comprises a first lower side box that is operatively coupled to the first upper side box and a second lower side box that is operatively coupled to the second upper side box.

21. The system of claim 20 wherein the first upper side box is adapted to be releasably coupled to the second upper side box by a plurality of upper connection members and wherein the first lower side box is adapted to be releasably coupled to the second lower side box by a plurality of lower connection members.

22. The system of claim 21 wherein the plurality of upper connection members is adapted to define a size of the upper open space when releasably coupling the first and second upper side boxes and wherein the plurality of lower connection members is adapted to define a size of the lower open space when releasably coupling the first and second lower side boxes.

23. The system of claim 12 wherein the mast is adapted be erected on the substructure and raised with the upper box after erection.

24. The method of claim 1 wherein operatively coupling the upper box to the lower box comprises operatively coupling a first upper side box of said upper box to a first lower side box of said lower box and operatively coupling a second upper side box of said upper box to a second lower side box of said lower box.

25. The method of claim 24 wherein assembling the substructure further comprises releasably coupling the first upper side box to the second upper side box so as to define a size of the upper open space and releasably coupling the first lower side box to the second lower side box so as to define a size of the lower open space.

26. The method of claim 25 wherein moving the vehicle with the floor section positioned thereon into the upper open space and lower open space comprises moving the vehicle between at least the first lower side box and the second lower side box.

27. The method of claim 10 wherein the upper box of the substructure is raised to said operational height after securing the floor section and the drawworks to the upper box and erecting the mast.

28. The substructure of claim 18, further comprising a raising apparatus that is adapted to raise the upper box to said operational height after the floor section and the drawworks are releasably connected to the upper box.

29. The substructure of claim 28 wherein the raising apparatus is further adapted to raise the upper box to said operational height after a mast has been pivotably connected to and erected on the upper box.

30. The substructure of claim 18, further comprising a plurality of mast connections that are adapted to pivotably connect a mast to the upper box and to support the mast during mast erection.

31. The substructure of claim 18 wherein the upper box comprises first and second upper side boxes and the lower box comprises first and second lower side boxes, the substructure further comprising a plurality of upper connection members that are adapted to releasably couple the first and second upper side boxes and define a size of the upper open space, and a plurality of lower connection members that are adapted to releasably couple the first and second lower side boxes and define a size of the lower open space.

* * * * *